US007561824B2

(12) United States Patent
Williams et al.

(10) Patent No.: US 7,561,824 B2
(45) Date of Patent: Jul. 14, 2009

(54) SYSTEM AND METHOD FOR REMANUFACTURING IMAGING COMPONENTS

(75) Inventors: James R. Williams, Sims, NC (US); Donald R. Huck, Sanford, NC (US); James H. Jones, Fayetteville, NC (US); Anthony D. Causey, Fuquay-Varina, NC (US); Thomas J. Martin, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 0 days.

(21) Appl. No.: 12/195,080

(22) Filed: Aug. 20, 2008

(65) Prior Publication Data

US 2008/0310880 A1 Dec. 18, 2008

Related U.S. Application Data

(63) Continuation of application No. 11/191,544, filed on Jul. 28, 2005, now Pat. No. 7,424,244.

(51) Int. Cl.
*G03G 15/00* (2006.01)

(52) U.S. Cl. ..... 399/109

(58) Field of Classification Search ..... 399/109, 399/159, 167, 117

See application file for complete search history.

(56) References Cited

U.S. PATENT DOCUMENTS

| | | | | |
|---|---|---|---|---|
| 7,346,292 | B2 * | 3/2008 | Williams et al. | 399/109 |
| 7,424,244 | B2 * | 9/2008 | Williams et al. | 399/109 |
| 7,480,472 | B2 * | 1/2009 | Williams et al. | 399/109 |

* cited by examiner

*Primary Examiner*—Susan S Lee

(57) ABSTRACT

Systems and methods of remanufacturing an imaging cartridge including the replacement an organic photo conductor (OPC) drum in the imaging cartridge having end caps which are fixedly secured to the waste bin or other portion of the toner cartridge. In one aspect, the method involves removing the existing OPC drum without detaching the end caps and installing a replacement OPC drum without disturbing the end caps.

4 Claims, 19 Drawing Sheets

SYSTEM AND METHOD FOR REMANUFACTURING IMAGING COMPONENTS

The present application is a continuation of allowed U.S. patent application Ser. No. 11/191,544 which is herein incorporated by reference in its entirety.

BACKGROUND

The present invention generally relates to manufacturing, remanufacturing or repairing replaceable imaging components, and more particularly to apparatus and techniques for replacing a drum or roller, such as an organic photo conductor (OPC) drum, for example, of a replaceable imaging cartridge adapted for holding marking material.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Laser printer toner cartridges are typically composed of two portions. One of these sections is the waste bin assembly which houses the OPC drum. During the remanufacturing of a laser printer toner cartridge, the OPC drum may need to be replaced due to the wear or damage of the OPC drum. Typically, the OPC drum is held in place by opposing removable plates. These removable plates are typically attached to the waste bin by screws which allow a remanufacturer to easily remove at least one of the removable plates, replace the OPC drum, and reattach the removable plate. Such a technique allows for OPC drum replacement without causing damage to the toner cartridge.

In the case of certain toner cartridges, such as the Hewlett-Packard Color LaserJet 2600, removable plates are not utilized to secure the OPC drum in place. Rather, the OPC drum is held in place by opposing end caps which are not readily removable. These end caps are secured to the waste bin using, among other techniques, an adhesive, which prevents any easy disassembly. Moreover, forcing the removal of the end caps causes damage to the end cap and/or the waste bin. This damage results in print defects when the cartridge is reassembled due to the replacement OPC drum not being securely fastened to the waste bin housing as well as changes in the centerline of the OPC drum in relation to other cartridge components which leads to out of round rotation. Therefore, it would be advantageous to provide systems and methods replacing an OPC drum in a toner cartridge having end caps which are fixedly secured to the waste bin or other portion of the toner cartridge.

SUMMARY

In one aspect of the present invention a method of remanufacturing an imaging cartridge comprises providing the toner cartridge comprising an organic photo conductor (OPC) retaining member including an opening, providing a replacement OPC drum including an internal retaining member, placing the OPC drum proximate the OPC retaining member, inserting an external hub into the opening of the OPC retaining member, and attaching the external hub to the internal retaining member.

In another aspect of the present invention, a method of remanufacturing a toner cartridge comprises providing the toner cartridge comprising an organic photo conductor (OPC) retaining member including an opening, providing a replacement OPC drum including an internal hub, placing the OPC drum proximate the OPC retaining member, and withdrawing at least a portion of the internal hub into the opening of the OPC retaining member.

In another aspect of the present invention, a method of remanufacturing a toner cartridge comprises providing the toner cartridge comprising an organic photo conductor (OPC) retaining member including an opening, providing a replacement OPC drum, placing the OPC drum proximate the OPC retaining member, and inserting at least a portion of a shaft through said opening of the OPC retaining member and at least partially into the OPC drum.

In another aspect of the present invention, a method of remanufacturing a toner cartridge comprises providing the toner cartridge comprising an organic photo conductor (OPC) retaining member including an opening, providing a replacement OPC drum including a retractable hub, at least partially retracting the retractable hub into the interior of the of the OPC drum, placing the OPC drum proximate the OPC retaining member, and releasing the retractable external hub to allow the retractable hub to expand into the opening of the OPC retaining member.

In another aspect of the present invention, a method of remanufacturing a toner cartridge comprises providing the toner cartridge comprising an organic photo conductor (OPC) retaining member including an opening, providing a replacement OPC drum, placing the OPC drum proximate the OPC retaining member, placing an expandable hub assembly between the OPC drum and the opening of the OPC retaining member, and expanding the expandable hub assembly into engagement with the OPC drum and the OPC retaining member.

In another aspect of the present invention, a method of remanufacturing a toner cartridge comprises providing the toner cartridge comprising an organic photo conductor (OPC) retaining member including an opening, removing a portion of the OPC retaining member to form a void in the OPC retaining member, installing a replacement OPC drum in the OPC retaining member through the void, and filling the void in the OPC retaining member.

In another aspect of the present invention, a method of remanufacturing a toner cartridge comprises providing the toner cartridge comprising an organic photo conductor (OPC) retaining member including an opening, providing a replacement OPC drum including a hub extending from an end of the OPC drum, inserting a portion of the hub into the opening of the OPC retaining member, and placing a spacer element between the end of the OPC drum and the OPC retaining member.

In another aspect of the present invention, a method of remanufacturing a toner cartridge comprises providing the toner cartridge comprising first and second organic photo conductor (OPC) retaining members, each OPC retaining member including an opening, providing a replacement OPC drum including a hub extending from a first end of the OPC drum, inserting a portion of the hub into the opening of the first OPC retaining member, and placing a buffer element between a second end of the OPC drum and the second OPC retaining member.

In another aspect of the present invention, a method of remanufacturing a toner cartridge comprises providing the toner cartridge comprising an organic photo conductor (OPC) retaining member including an opening, providing a replacement OPC drum including a first portion of a hub, placing the OPC drum proximate the OPC retaining member, inserting a second portion of the hub into said opening of the OPC retaining member, and attaching the first portion of the hub to the second portion of the hub.

In another aspect of the present invention, a method of remanufacturing a toner cartridge including a waste bin assembly comprises removing the waste bin assembly from the toner cartridge, the waste bin assembly including a waste bin and end caps attached to a waste bin in a manner which does not allow the ready detachment of the waste bin from the end caps without damaging the waste bin, and installing a new waste bin assembly.

In another aspect of the present invention, a method of remanufacturing a toner cartridge comprises providing the toner cartridge comprising first and second organic photo conductor (OPC) retaining members, each OPC retaining member including an opening, providing a replacement OPC drum assembly comprising an OPC drum and first and second hubs, the OPC drum assembly being at least partially disassembled, placing the OPC drum between the first and second OPC retaining members, and assembling the partially disassembled OPC drum assembly.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing a toner cartridge, such as an HP 2600 toner cartridge, are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
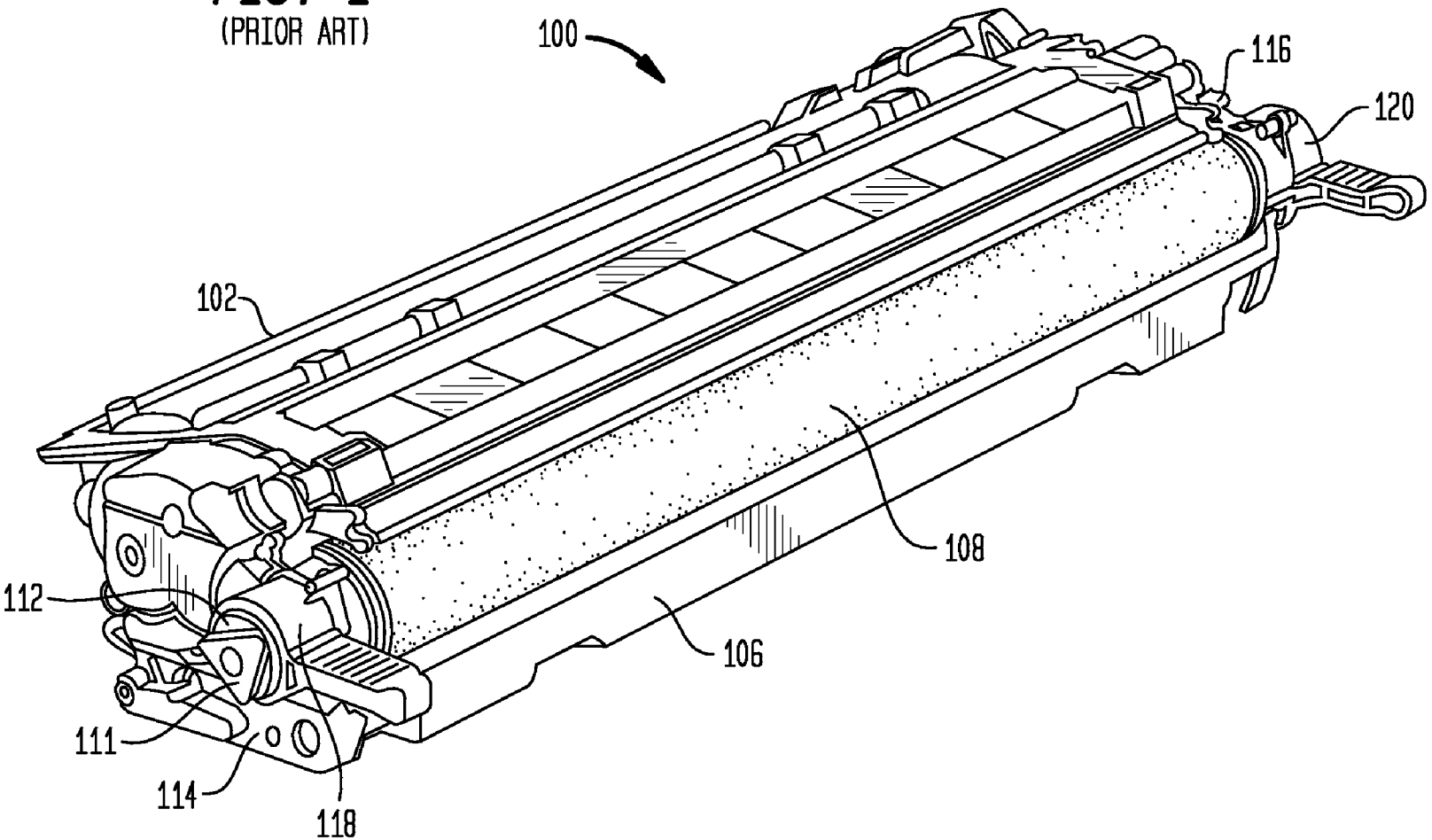
FIG. 1 (PRIOR ART)
FIG. 1 shows a perspective view of the drive side end of an HP 2600 toner cartridge.
Figure 2:
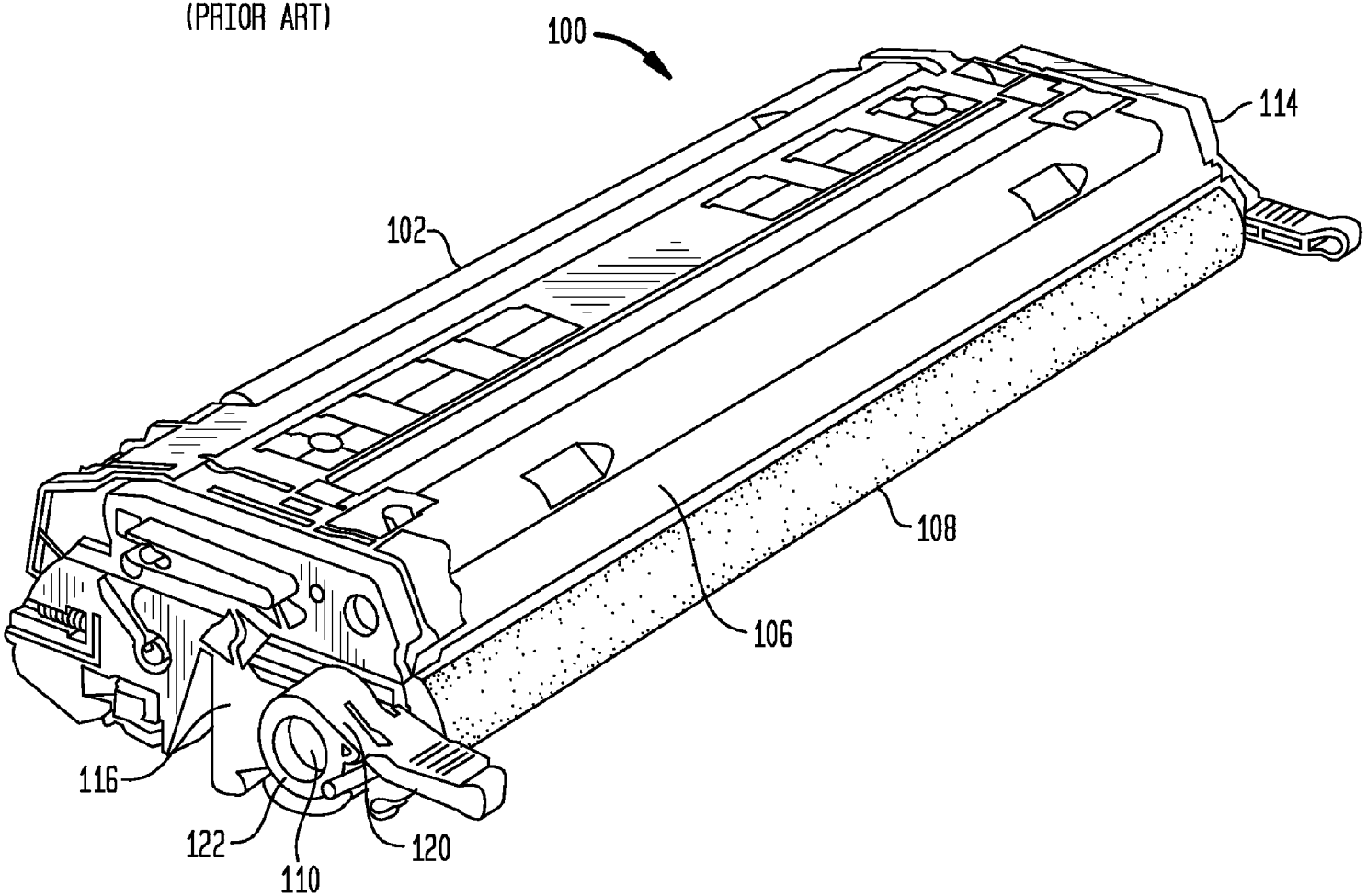
FIG. 2 (PRIOR ART)
FIG. 2 shows a perspective view of the non-drive side end view of an HP 2600 toner cartridge.
Figure 3:
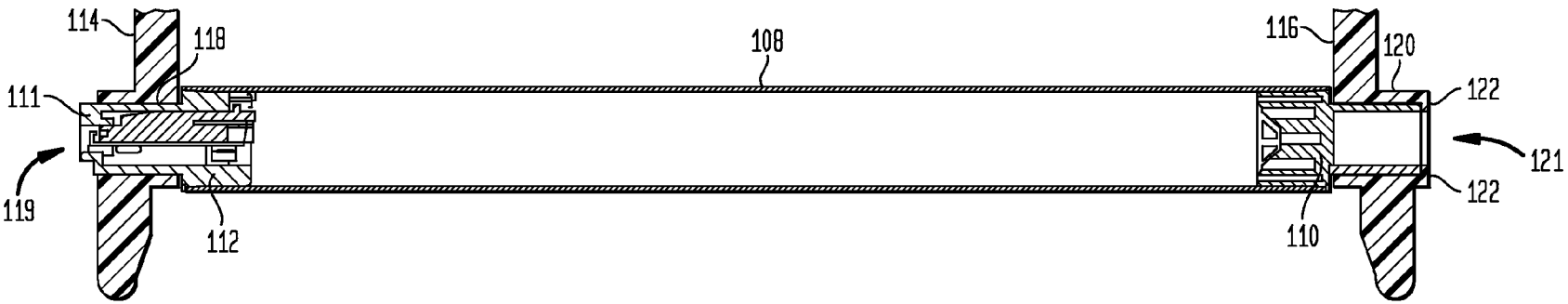
FIG. 3 (PRIOR ART)
FIG. 3 shows a cross-sectional view of the OPC drum and end caps of an HP 2600 toner cartridge.
Figure 3A:
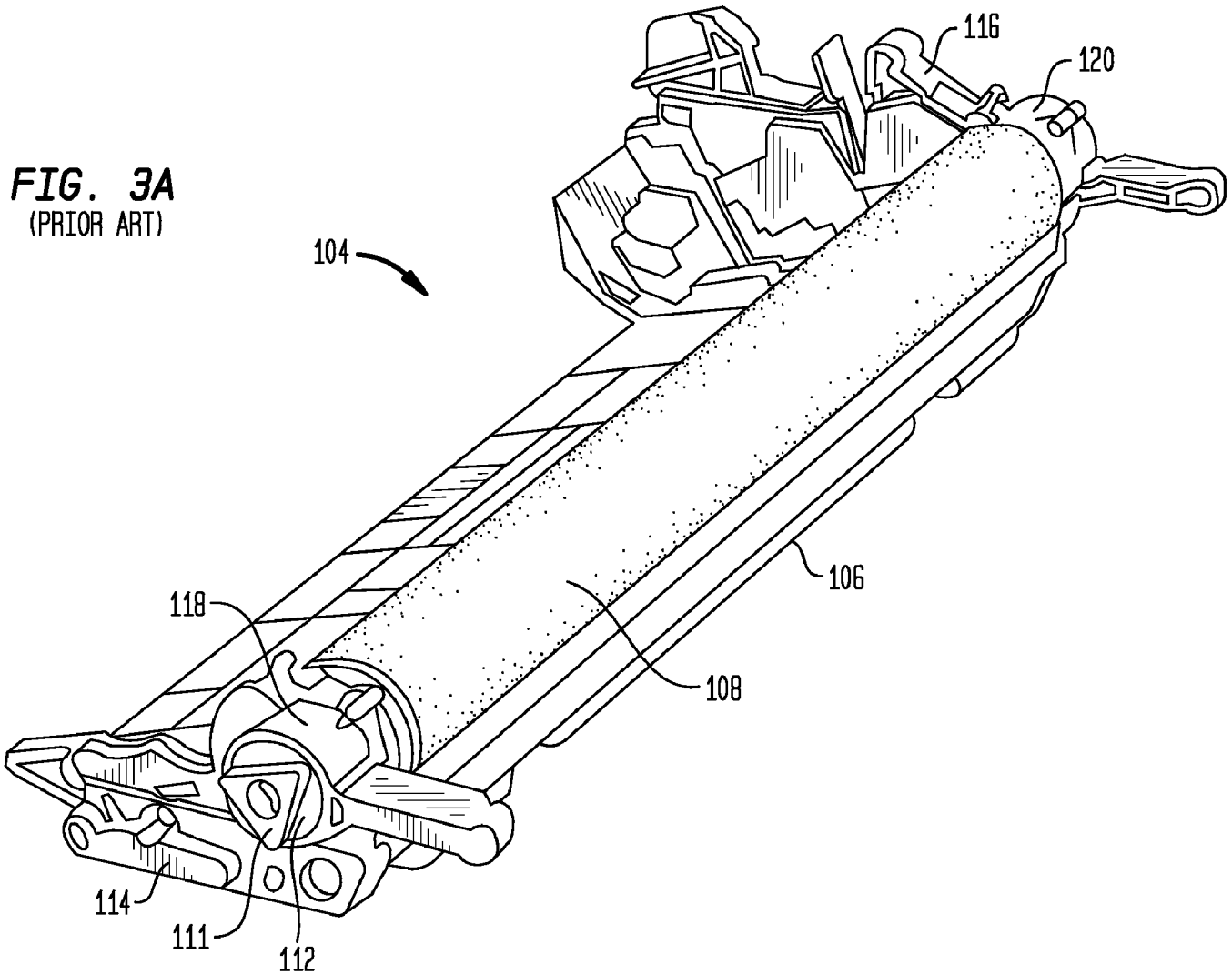
FIG. 3A (PRIOR ART)
FIGS. 3A and 3B show perspective views of a waste bin assembly.
Figure 3B:
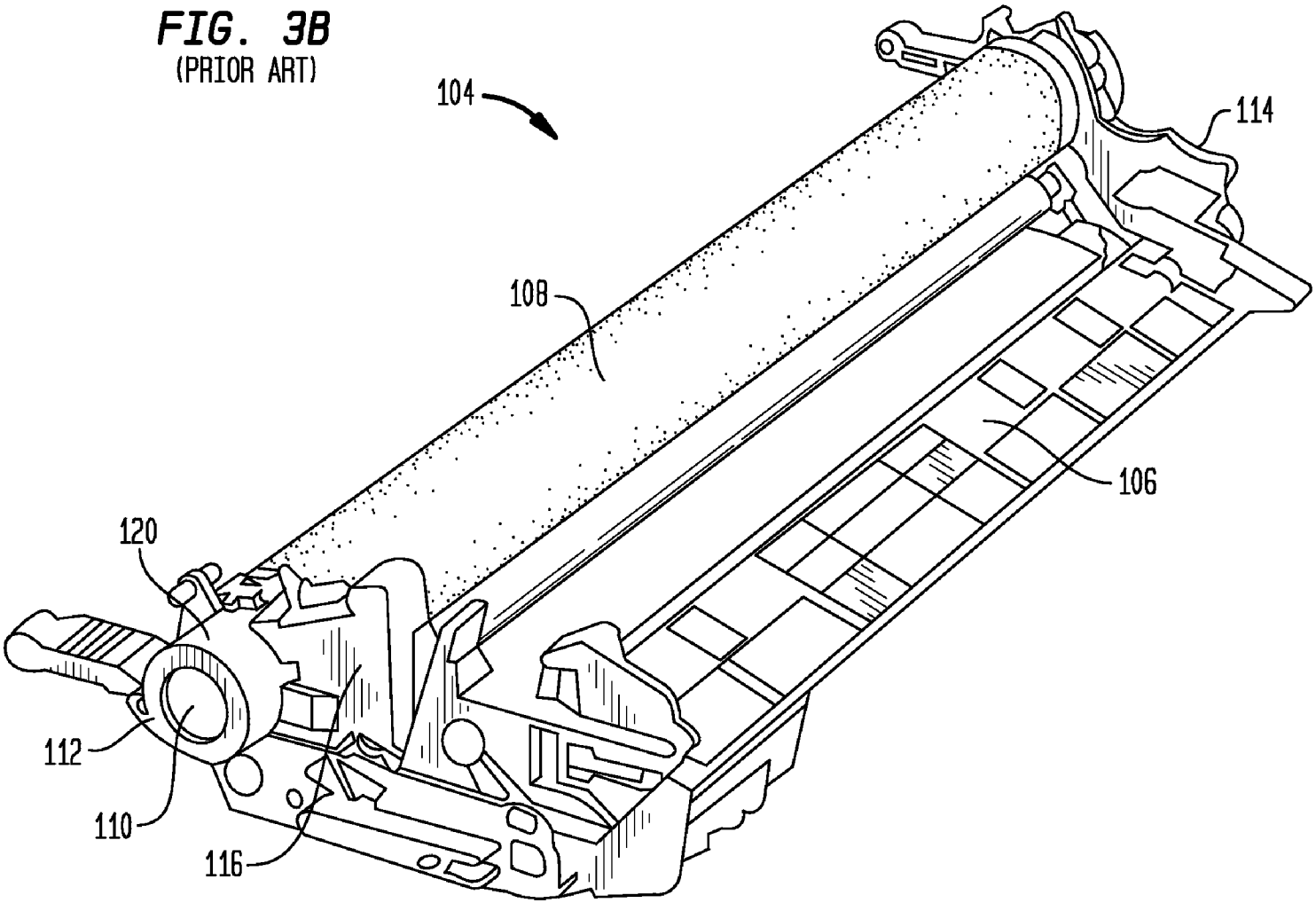
FIG. 3B (PRIOR ART)

FIGS. 1 and 2 show perspective views of a prior art toner cartridge 100. The toner cartridge 100 includes, among other components, a toner hopper assembly 102 and a waste bin assembly 104. The waste bin assembly 104 includes a waste bin 106 and an organic photo conductor (OPC) drum 108. The OPC drum 108 comprises a cylindrical aluminum tube having first and second hubs 110 and 112, with each hub 110 and 112 extending from an end of the OPC drum 108. The second hub 112 includes a trilobe 111 extension which is used by the printer to rotate the OPC drum 108 during the printing process. The OPC drum 108 is held in place by a drive side end cap 114 and a non-drive side end cap 116 which include OPC retaining members 118 and 120, respectively. The OPC retaining members 118 and 120 each include cylindrical openings 119 and 121 respectively which engage and hold the ends of the hubs 110 and 112 during the rotation of the OPC drum 108. The cylindrical opening 121 of the OPC retaining member 120 is narrowed at the end by a flange 122. A clearer view of the this relationship is provided in FIG. 3 which shows a cross-sectional view of a portion of the waste bin assembly 104 including the OPC drum 108, the drive side end cap 114 and the non-drive side end cap 116. See also FIGS. 3A and 3B, which show perspective views of the waste bin assembly 104 after removal from the toner cartridge 100. These end caps 114 and 116 are secured to the waste bin 106 using, among other techniques, an adhesive, which inhibits the removal of either of the end caps 114 and 116 without causing undesirable damage to the end caps 114 and 116 and the waste bin 104. As described above, such damage may result in print defects when the toner cartridge 100 is reassembled. Thus, it is desirable to remove a currently installed OPC drum and replace it with a new OPC drum without disturbing the end caps 114 and 116. As described in U.S. patent application Ser. No. 11/193,944, entitled "Systems and Methods for Remanufacturing Imaging Components" filed on the same date as the present application, and incorporated by reference herein in its entirety, a variety of suitable techniques may be used to remove the currently installed OPC drum with causing undesirable damage to the end caps 114 and 116. After the old OPC drum is removed, a replacement OPC drum must be installed.

The present invention provides systems and methods installing an OPC drum in a toner cartridge having end caps that are fixedly secured to the waste bin or other portion of the toner cartridge. In general, the techniques described below may be used with either the drive side end cap 114, the non-drive side end cap 116, or both. For example, one technique may be used with the drive side end cap 114 and a different technique may be used with the non-drive end cap 116, or the same technique may be used with both the drive side end cap 114 and the non-drive side end cap 116.

Figure 4:
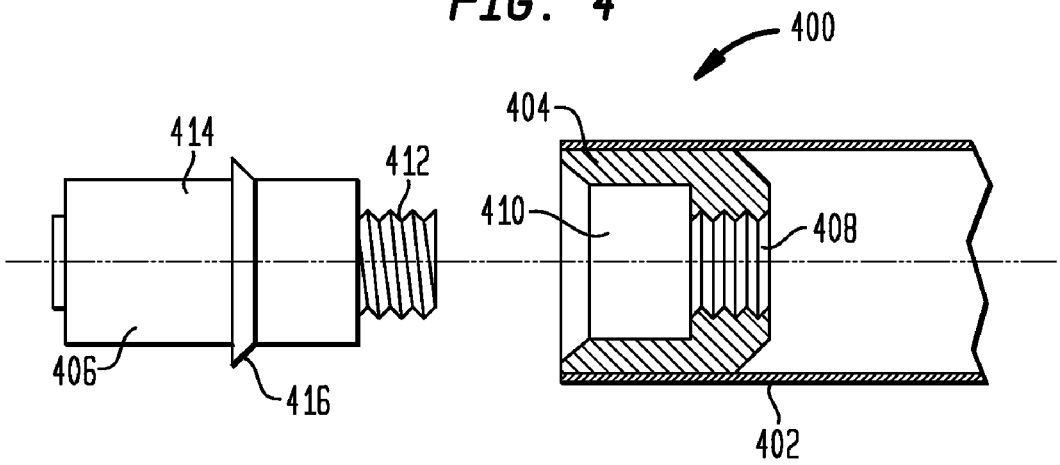
FIG. 4 shows a cross-sectional view of a portion of an OPC drum assembly in accordance with one aspect of the present invention.

FIG. 4 shows a cross-sectional view of a portion of an OPC drum assembly 400 in accordance with the present invention. The OPC drum assembly 400 comprises an OPC drum 402, an internal retaining member 404 and an external hub 406. The internal retaining member 404 is shaped to be placed into the interior of the OPC drum 402 and may be held in place by glue or some other suitable technique. The internal retaining member 404 may include a threaded aperture 403 and a cavity 410. A portion of the internal retaining member 404 may extend outward from the interior of the OPC drum 402. The internal retaining member 404 may be formed from plastic resin and by injection molding. The external hub 406 comprises a cylindrical body 414 sized to fit within the cylindrical openings 119 or 121 and a threaded extension 412 sized to engage the threaded aperture 408. The external hub 406 is generally cylindrical in shape and may be formed from plastic resin and by injection molding. For installation into a toner cartridge, the OPC drum 402 (with the internal retaining member 404 inserted into an end and affixed in place) is placed into position between the OPC retaining members 118 and 120. The external hub 406 is inserted through the adjacent cylindrical opening 119 or 121 into the cavity 410 and the threaded extension 412 is screwed into the threaded aperture 408 to secure the external hub 406 to the internal retaining member 404. Adhesives or locking features combined with the threads may be used to ensure that the external hub 406 does not unscrew during operation of the toner cartridge. To facilitate ease of installation on the non-drive side end cap 116, flange 122 of the OPC retaining member 120 may be removed by machining if needed. In another aspect of the present invention, the installation may be performed by first placing external hub 406 into the cylindrical opening 119 or 121 and then placing OPC drum 402 with the internal retaining member 404 into position between the OPC retaining members 118 and 120, and then screwing the threaded extension 412 into the threaded aperture 408. The external hub 406 may include an optional flange 416 which would recess into the internal retaining member 404 to center the external hub 406 and ensure that the appropriate dimensions are maintained for proper cartridge operation. The same technique or an alternate technique may be utilized for the installation of the other end of the OPC drum 402. Quality bearing surfaces and concentricity between the bearing surfaces and the center of rotation of the OPC drum 402 should be maintained for proper operation of the toner cartridge and to prevent print defects due to out of round rotation of the OPC drum 402.

Figure 5:
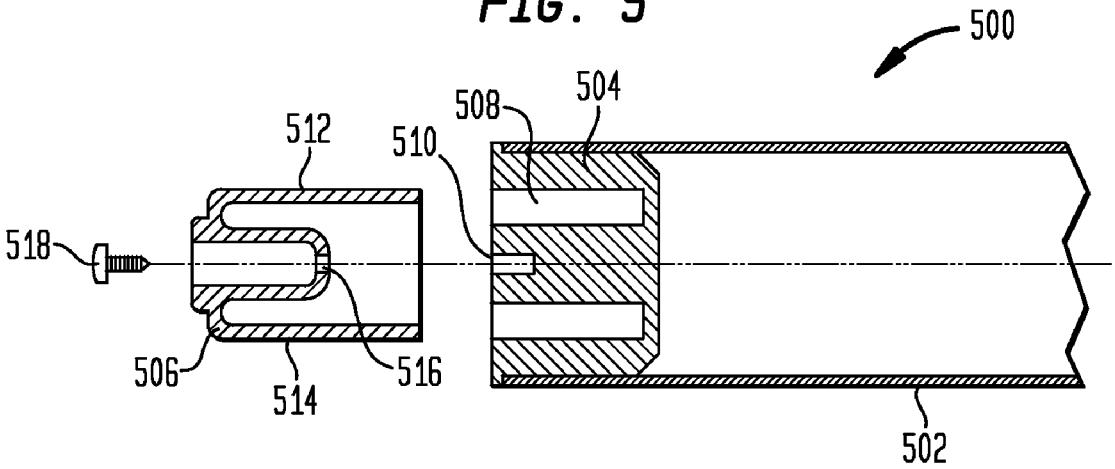
FIG. 5 shows a cross-sectional view of a portion of an OPC drum assembly in accordance with another aspect of the present invention.

FIG. 5 shows a cross-sectional view of a portion of an OPC drum assembly 500 in accordance with the present invention. The OPC drum assembly 500 comprises an OPC drum 502, an internal retaining member 504 and an external hub 506. The internal retaining member 504 is shaped to be placed into the interior of the OPC drum 502 and may be held in place by glue or some other suitable technique. The internal retaining member 504 may include one or more recessed slots 508 and an engagement bore 510. In a preferred embodiment, the recessed slot 508 comprises a recessed cylindrical cavity. A portion of the internal retaining member 504 may extend outward from the interior of the OPC drum 502. The internal retaining member 504 may be formed from plastic resin and by injection molding. The external hub 506 comprises a cylindrical body 514 sized to engage cylindrical openings 119 and 121 and an extension member 512 sized to engage the one or more recessed slots 508. The external hub 506 also includes an opening 516 which will align with the recessed bore 510 when the external hub 506 is inserted into the internal retaining member 504. The external hub 506 may be formed from plastic resin and by injection molding. For installation into a toner cartridge, the OPC drum 502 (with the internal retaining member 504 inserted into an end and affixed in place) is placed into position between the OPC retaining members 118 and 120. The external hub 506 is inserted through the adjacent cylindrical opening 119 or 121 and the extension member 512 is guided into the recessed slot 508. A screw is inserted into the opening 516 and screwed into the recessed bore 510 to secure the external hub 506 to the internal retaining member 504. Adhesives or locking features combined with the threads may be used to ensure that the external hub 506 does not unscrew during operation of the toner cartridge. To facilitate ease of installation on the non-drive side end cap 116, flange 122 of the OPC retaining member 120 may be removed by machining if needed. In another aspect of the present invention, the installation may be performed by first placing external hub 506 into the cylindrical opening 119 or 121 and then placing OPC drum 502 with the internal retaining member 504 into position between the OPC retaining members 118 and 120, and then engaging the external hub 506 with the internal retaining member 504. The same technique or an alternate technique may be utilized for the installation of the other end of the OPC drum 502. Quality bearing surfaces and concentricity between the bearing surfaces and the center of rotation of the OPC drum 502 should be maintained for proper operation of the toner cartridge and to prevent print defects due to out of round rotation of the OPC drum 502.

Figure 6:
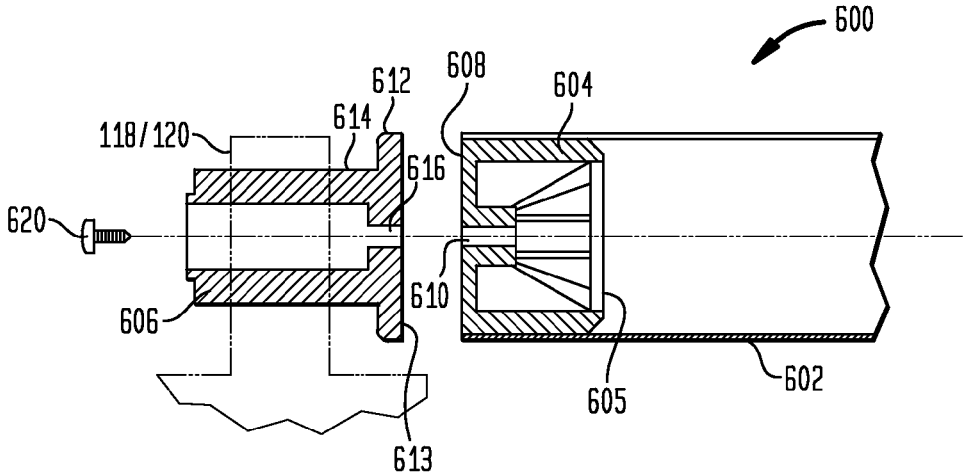
FIG. 6 shows a cross-sectional view of a portion of an OPC drum assembly in accordance with another aspect of the present invention.

FIG. 6 shows a cross-sectional view of a portion of an OPC drum assembly 600 in accordance with the present invention. The OPC drum assembly 600 comprises an OPC drum 602, an internal retaining member 604 and an external hub 606. In FIG. 6, a portion of an OPC retaining member 118 or 120 is shown with dashed lines. The internal retaining member 604 is shaped to be placed into the interior of the OPC drum 602 and may be held in place by glue or some other suitable technique. The internal retaining member 604 may include an engagement bore 610 disposed in the center of a front surface 608. In a preferred embodiment, the front surface 608 of the internal retaining member 604 is substantially flat, but may include other surface features adapted for engagement with the external hub 606. The internal retaining member 604 may also include structural members 605 which provide additional support and rigidity to the internal retaining member 604. A portion of the internal retaining member 604 may extend outward from the interior of the OPC drum 602. The internal retaining member 604 may be formed from plastic resin and by injection molding. The external hub 606 comprises a cylindrical body 614 sized to engage cylindrical openings 119 and 121 and a flange 612 having a surface 613 adapted to engage the front surface 608 of the internal retaining member 604. The external hub 606 also includes an opening 616 which will align with the engagement bore 610 when the external hub 606 is properly positioned adjacent to the internal retaining member 604. The external hub 606 may be formed from plastic resin and by injection molding. For installation into a toner cartridge, the external hub 606 is inserted through the adjacent cylindrical opening 119 or 121 and the OPC drum 602 (with the internal retaining member 604 inserted into an end) is placed into position between the OPC retaining members 118 and 120 such that the surface 613 abuts front surface 608 and the opening 616 is aligned with the engagement bore 610. A screw 620 is inserted into the opening 616 and screwed into the engagement bore 610 to secure the external hub 606 to the internal retaining member 604. Adhesives or locking features combined with the threads may be used to ensure that the external hub 606 does not become loose during operation of the toner cartridge. The same technique or an alternate technique may be utilized for the installation of the other end of the OPC drum 602. Quality bearing surfaces and concentricity between the bearing surfaces and the center of rotation of the OPC drum 602 should be maintained for proper operation of the toner cartridge and to prevent print defects due to out of round rotation of the OPC drum 602.

Figure 7:
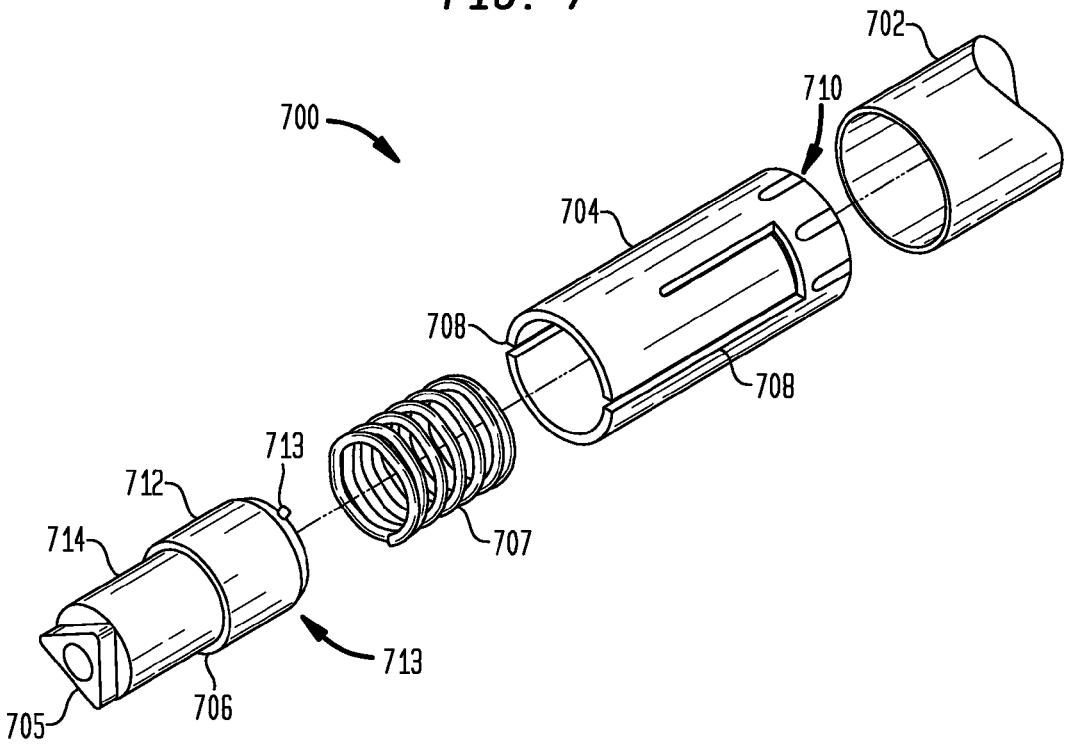
FIGS. 7-9 show perspective views of a portion of an OPC drum assembly in accordance with another aspect of the present invention.
Figure 8:
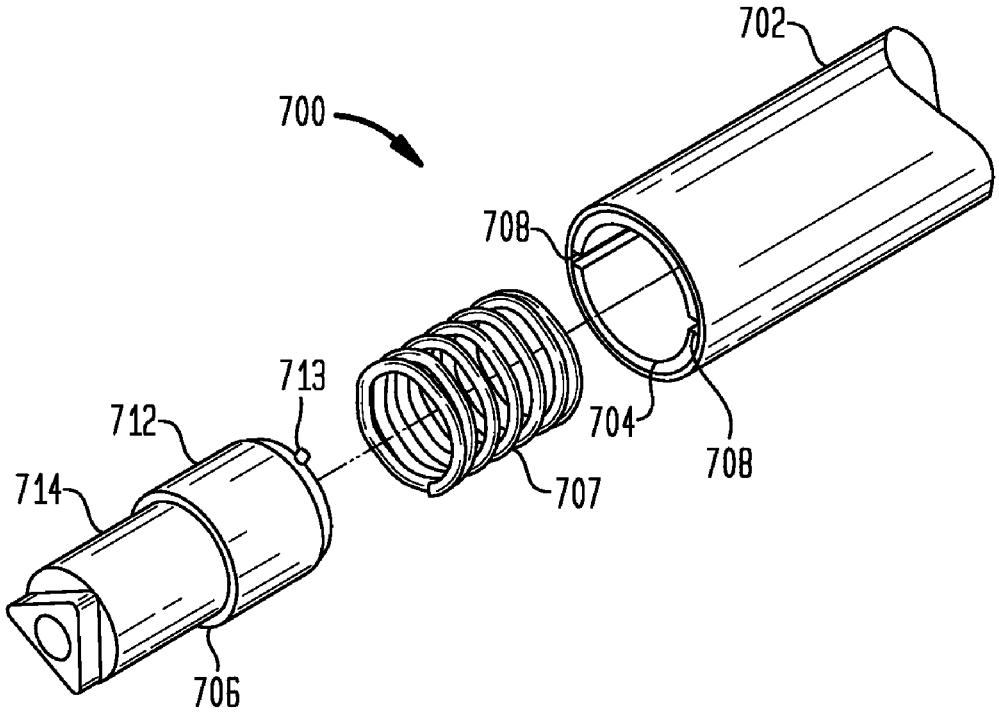
Figure 9:
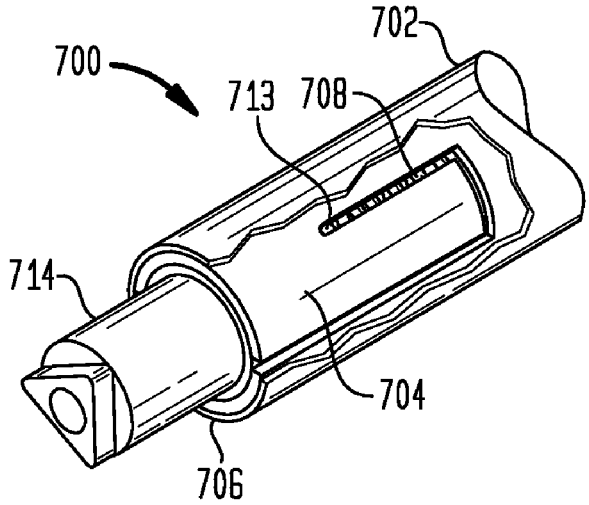

FIGS. 7-9 show perspective views of an OPC drum assembly 700 in accordance with the present invention. The OPC drum assembly 700 comprises an OPC drum 702, an internal retaining member 704, an external hub 706 and a spring 707. The internal retaining member 704 is shaped to be placed into the interior of the OPC drum 702 and may be held in place by glue or some other suitable technique. The internal retaining member 704 includes opposing slots 708 (also known as "J-channels" due to their shape) and a flat bottom 710 to hold the spring 707 within the internal housing member 704. A portion of the internal retaining member 704 may extend outward from the interior of the OPC drum 702. The internal retaining member 704 may be formed from plastic resin and by injection molding. The external hub 706 comprises a cylindrical body 714 sized to fit within the cylindrical openings 119 or 121, an extension 712 sized to fit within the internal retaining member 704, and opposing ribs 713 sized to fit within the opposing slots 708. The external hub 706 may also include a trilobe extension 705. The external hub 706 is generally cylindrical in shape and may be formed from plastic resin and by injection molding. To assemble the OPC drum assembly 700, the internal retaining member 704 is inserted the OPC drum 702 and glued into place, as shown in FIG. 8. The spring 707 is then placed into the internal retaining member 704 and supported by the bottom 710. Next, the external hub 706 is then inserted into the internal retaining member 704, aligning the ribs 713 with the slots 708. Pressure is applied to the external hub 706 until the spring 707 is sufficiently compressed to allow the external hub 706 to be rotated and locked into place within the internal retaining member 704, as shown in FIG. 9. For installation into a toner cartridge, the external hub 706 is compressed into the internal retaining member 704. The OPC drum assembly 700 is placed into position between the OPC retaining members 118 and 120. The external hub 706 is then released and the spring 707 forces the external hub 706 through the adjacent cylindrical opening 119 or 121 into the appropriate operating position. The same technique or an alternate technique may be utilized for the installation of the other end of the OPC drum 702. Quality bearing surfaces and concentricity between the bearing surfaces and the center of rotation of the OPC drum 702 should be maintained for proper operation of the toner cartridge and to prevent print defects due to out of round rotation of the OPC drum 702.

Figure 10:
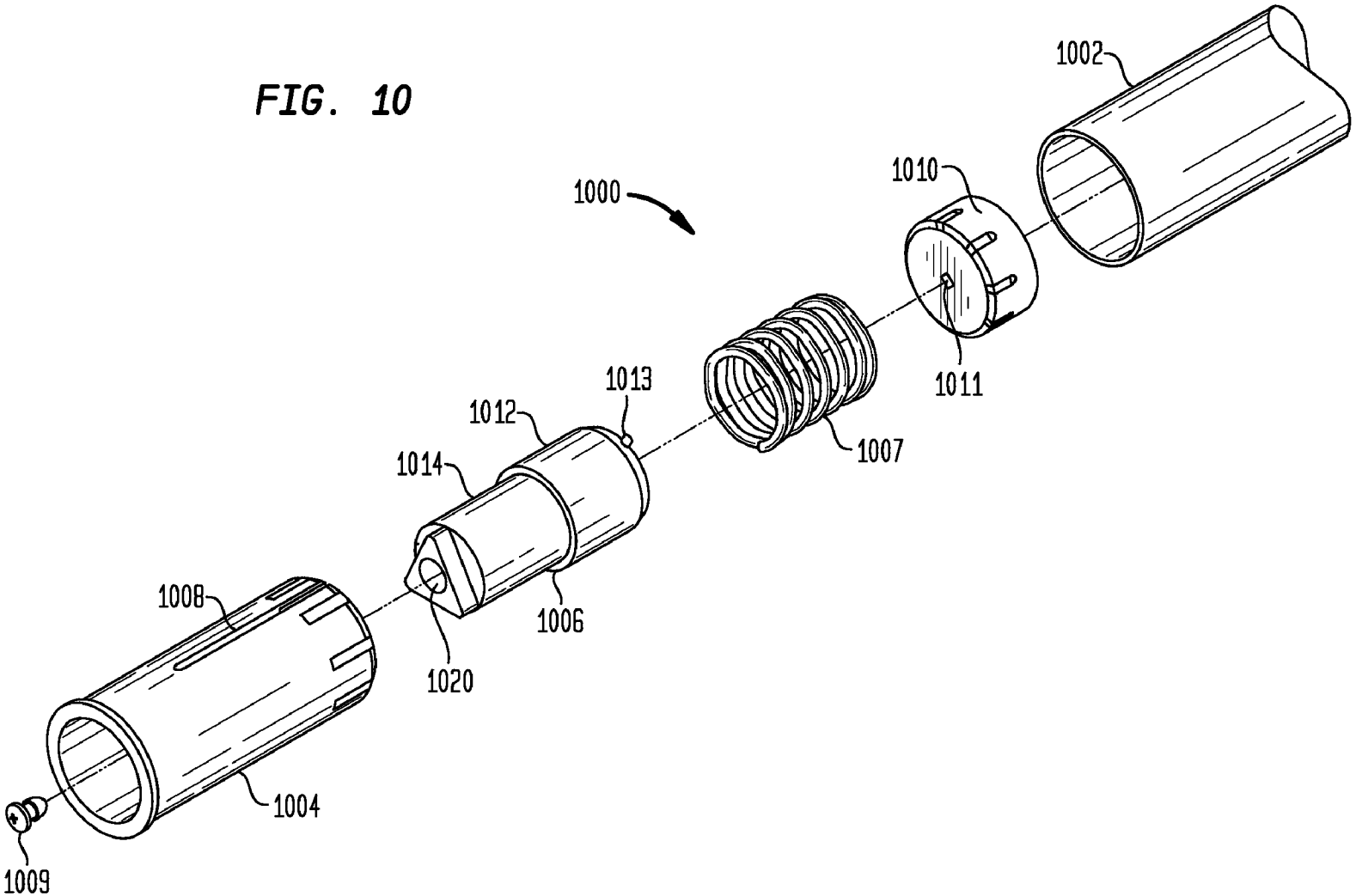
FIG. 10 shows a perspective view of an alternate embodiment of the OPC drum assembly of FIGS. 7-9 in accordance with another aspect of the present invention.

FIG. 10 shows a perspective view of an OPC drum assembly 1000 in accordance with the present invention. The OPC drum assembly 1000 is an alternate embodiment of the OPC drum assembly 700. The OPC drum assembly 1000 comprises an OPC drum 1002, an internal retaining member 1004, an external hub 1006, a spring 1007, a retainer insert 1010 and a quarter turn screw 1009. The internal retaining member 1004 is shaped to be placed into the interior of the OPC drum 1002. The internal retaining member 1004 includes opposing slots 1008. The retainer insert 1010 is shaped to be placed into the interior of the OPC drum 1002 and engage the internal retaining member 1004. The retainer insert 1010 includes a locking cutout 1011 adapted for engagement with a connector, such as the quarter turn screw 1009, for example. A portion of the internal retaining member 1004 may extend outward from the interior of the OPC drum 1002 when the OPC drum assembly 1000 is assembled. The internal retaining member 1004 may be formed from plastic resin and by injection molding. The external hub 1006 comprises a cylindrical body 1014 sized to fit within the cylindrical openings 119 or 121, an extension 1012 sized to fit within the internal retaining member 1004, and opposing ribs 1013 sized to fit within the opposing slots 1008. The external hub 1006 is generally cylindrical in shape and may be formed from plastic resin and by injection molding. To assemble the OPC drum assembly 1000, the external hub 1006 is inserted into the internal retaining member 1004 with the ribs 1013 aligned with the slots 1008. The spring 1007 is then placed into the internal retaining member 1004. The retainer insert 1010 is then affixed, by adhesive, for example, to the bottom of the internal retaining member 1004, such that the spring 1007 is disposed between the external hub 1006 and the retainer insert 1010. A locating ledge (not shown) within the internal retaining member may be used to ensure proper placement of the retainer insert 1010. The quarter turn screw 1009 is inserted through an opening 1020 in the external hub 1006. Pressure is applied to the external hub 1006 to force the external hub 1006 into internal retaining member 1004 until the spring 1007 is sufficiently compressed to allow the screw 1009 to be rotated and locked into place within the locking cutout 1011. The resulting sub-assembly is then affixed, by adhesive for example, within the OPC drum 1002 to form the OPC drum assembly 1000. For installation in a toner cartridge, the OPC drum assembly 1000 is placed into position between the OPC retaining members 118 and 120. The external hub 1006 is then released by turning the quarter turn screw 1009 until screw 1009 is released by the locking cutout 1011. The spring 1007 pressure forces the external hub to extend a predetermined setting based on the length of the slots 1008. The same technique or an alternate technique may be utilized for the installation of the other end of the OPC drum 1002. Quality bearing surfaces and concentricity between the bearing surfaces and the center of rotation of the OPC drum 1002 should be maintained for proper operation of the toner cartridge and to prevent print defects due to out of round rotation of the OPC drum 1002.

Figure 11:
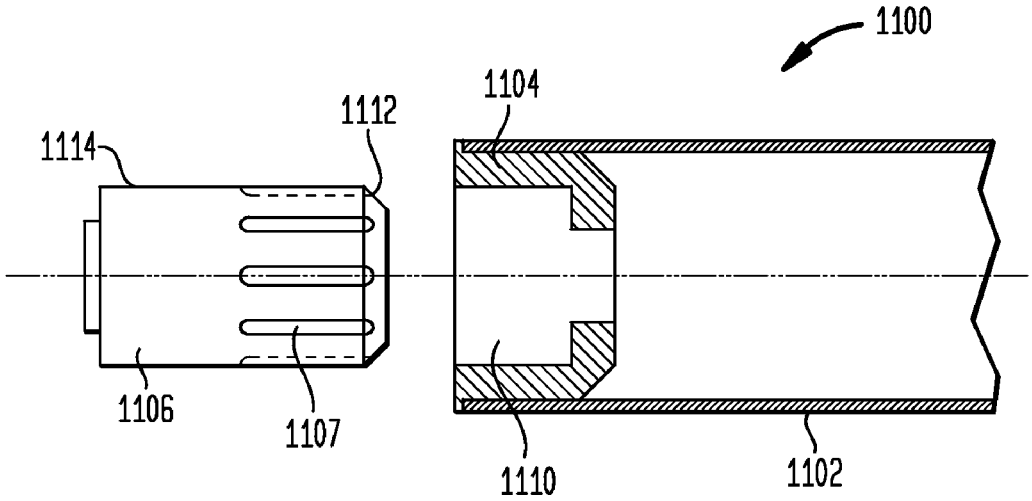
FIG. 11 shows a cross-sectional view of a portion of an OPC drum assembly in accordance with another aspect of the present invention.

FIG. 11 shows a cross-sectional view of a portion of an OPC drum assembly 1100 in accordance with the present invention. The OPC drum assembly 1100 comprises an OPC drum 11102, an internal retaining member 1104 and an external hub 1106. The internal retaining member 1104 is shaped to be placed into the interior of the OPC drum 1102 and may be held in place by glue or some other suitable technique. The internal retaining member 1104 may include a cavity 1110. A portion of the internal retaining member 1104 may extend outward from the interior of the OPC drum 1102. The internal retaining member 1104 may be formed from plastic resin and by injection molding. The external hub 1106 comprises a cylindrical body 1114 sized to fit within the cylindrical openings 119 or 121 and an extension 1112 sized to fit within the cavity 1110. The extension 1112 may include one or more glue slots 1107. The external hub 1106 is generally cylindrical in shape and may be formed from plastic resin and by injection molding. For installation into a toner cartridge, the OPC drum 1102 (with the internal retaining member 1104 inserted into an end and affixed in place) is placed into position between the OPC retaining members 118 and 120. The external hub 1106 is inserted through the adjacent cylindrical opening 119 or 121 into the cavity 1110 and adhered with an adhesive to the internal retaining member 1104 to ensure that the external hub 406 does not detach during operation of the toner cartridge. To facilitate ease of installation on the non-drive side end cap 116, flange 122 of the OPC retaining member 120 may be removed by machining if needed. In another aspect of the present invention, the installation may be performed by first placing external hub 1106 into the cylindrical opening 119 or 121 and then placing OPC drum 1102 with the internal retaining member 1104 into position between the OPC retaining members 118 and 120, and then adhering the extension 1112 to the internal retaining member. The same technique or an alternate technique may be utilized for the installation of the other end of the OPC drum 1102. Quality bearing surfaces and concentricity between the bearing surfaces and the center of rotation of the OPC drum 1102 should be maintained for proper operation of the toner cartridge and to prevent print defects due to out of round rotation of the OPC drum 1102.

Figure 12:
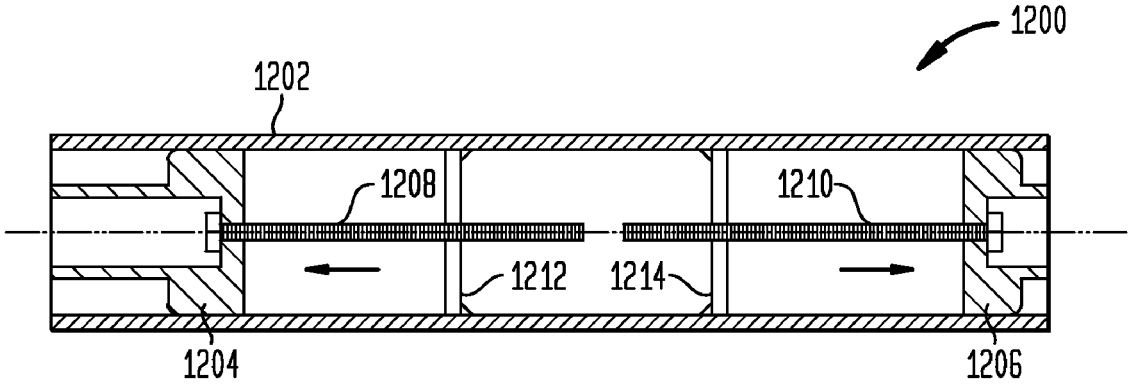
FIG. 12 shows a cross-sectional view of an OPC drum assembly in accordance with the present invention.

FIG. 12 shows a cross-sectional view of an OPC drum assembly 1200 in accordance with the present invention. The OPC drum assembly 1200 comprises an OPC drum 1202, hubs 1204 and 1206, threading screws 1208 and 1210, and stationary threaders 1212 and 1214. Each of the hubs 1204 and 1206 include a portion sized to fit within the OPC drum 1202 and a portion sized to fit within the cylindrical openings 119 and 121. The threaders 1212 and 1214, which each include a threaded hole in their centers, are affixed to the interior of the OPC drum 1202 in predetermined locations. The hubs 1204 and 1206 are then inserted into the OPC drum 1202. Threading screws 1208 and 1210 inserted through the centers of the hubs 1204 and 1206 and threaders 1212 and 1214. For installation into a toner cartridge, the screws are turned using a screwdriver or other driver tool to retract the hubs 1204 and 1206 sufficiently to allow the OPC drum 1102 to be placed into position between the OPC retaining members 118 and 120. The driver tool is then used to rotate the screws 1208 and 1210 and cause the hubs 1204 and 1206 to expand into proper position within the OPC openings 119 and 121. A form of thread lock may be encapsulated onto the threading screws 1208 and 1210 to make their location permanent after the hubs 1204 and 1206 have been extended. Alternately, a different technique may be utilized for the installation of one end of the OPC drum 1202. For example, one end of the OPC drum may include a hub which is fixed in place and the other end may include an extendable hub, as described above. Quality bearing surfaces and concentricity between the bearing surfaces and the center of rotation of the OPC drum 1102 should be maintained for proper operation of the toner cartridge and to prevent print defects due to out of round rotation of the OPC drum 1102.

Figure 13:
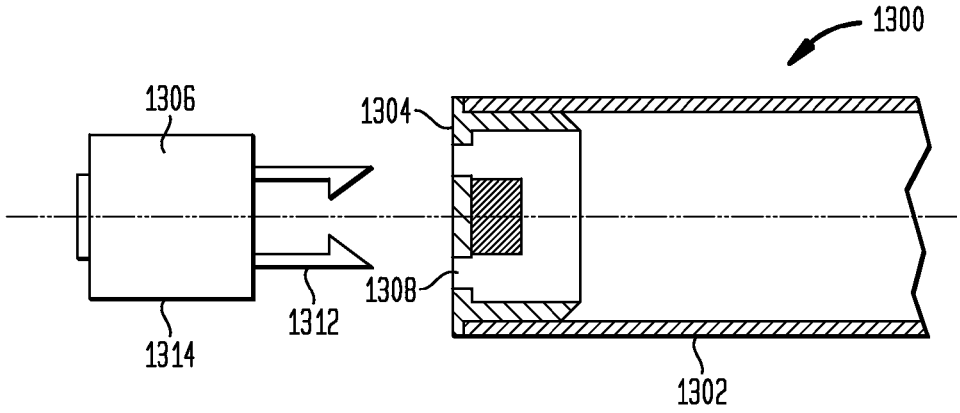
FIG. 13 shows a cross-sectional view of a portion of an OPC drum assembly in accordance with another aspect of the present invention.

FIG. 13 shows a cross-sectional view of a portion of an OPC drum assembly 1300 in accordance with the present invention. The OPC drum assembly 1300 comprises an OPC drum 1302, an internal retaining member 1304 and an external hub 1306. The internal retaining member 1304 is shaped to be placed into the interior of the OPC drum 1302 and may be held in place by glue or some other suitable technique. The internal retaining member 1304 includes a plurality of apertures 1308. A portion of the internal retaining member 1304 may extend outward from the interior of the OPC drum 1302. The internal retaining member 1304 may be formed from plastic resin and by injection molding. The external hub 1306 comprises a cylindrical body 1314 sized to fit within the cylindrical openings 119 or 121 and a plurality of snap-fit extensions 1312 sized to snap into and engage the apertures 1308. The external hub 1306 is generally cylindrical in shape and may be formed from plastic resin and by injection molding. For installation into a toner cartridge, the OPC drum 1302 (with the internal retaining member 1304 inserted into an end and affixed in place) is placed into position between the OPC retaining members 118 and 120. The external hub 1306 is inserted through the adjacent cylindrical opening 119 or 121 into the snap-fit extensions 1312 are forced through the apertures 1308 and locked into place. Adhesives or locking features combined with the snap-fit extensions 1312 may be used to ensure that the external hub 1306 does not move during operation of the toner cartridge. To facilitate ease of installation on the non-drive side end cap 116, flange 122 of the OPC retaining member 120 may be removed by machining if needed. In another aspect of the present invention, the installation may be performed by first placing external hub 1306 into the cylindrical opening 119 or 121 and then placing OPC drum 1302 with the internal retaining member 1304 into position between the OPC retaining members 118 and 120, and then snap-fit the extensions 1312 into the apertures 1308. The same technique or an alternate technique may be utilized for the installation of the other end of the OPC drum 1302. Quality bearing surfaces and concentricity between the bearing surfaces and the center of rotation of the OPC drum 1302 should be maintained for proper operation of the toner cartridge and to prevent print defects due to out of round rotation of the OPC drum 1302.

Figure 14:
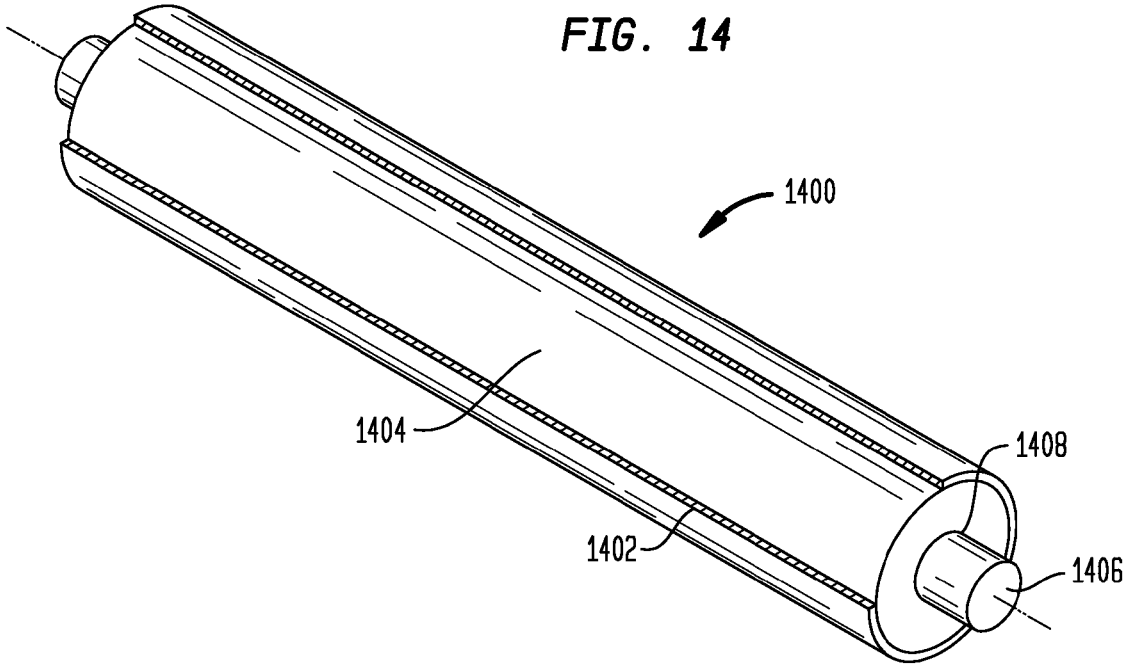
FIG. 14 shows a perspective sectional view of an OPC drum assembly in accordance with the present invention.

FIG. 14 shows a perspective view of an OPC drum assembly 1400 in accordance with another aspect of the present invention. The OPC drum assembly 1400 comprises an OPC drum 1402 and an internal shaft 1404 having a center bore 1408. In FIG. 14, a portion of the OPC drum 1402 is cut away to show the internal shaft 1404. The internal shaft 1404 is affixed within the OPC drum 1402 by adhesive or other suitable means and may be formed from plastic resin and by injection molding. The center bore 1408 is sized to receive an elongated hub 1406. The elongated hub 1406 comprises a cylindrical body sized to fit within the cylindrical openings 119 or 121 and may be formed from plastic resin and by injection molding. For installation into a toner cartridge, the OPC drum 1402 with the internal shaft 1404 is placed into position between the OPC retaining members 118 and 120. The elongated hub 1406 is then inserted through one of the cylindrical openings 119 or 121 and affixed in place with an adhesive or other suitable technique. To facilitate ease of installation on the non-drive side end cap 116, flange 122 of the OPC retaining member 120 may be removed by machining if needed. Quality bearing surfaces and concentricity between the bearing surfaces and the center of rotation of the OPC drum 1402 should be maintained for proper operation of the toner cartridge and to prevent print defects due to out of round rotation of the OPC drum 1402.

Figure 15:
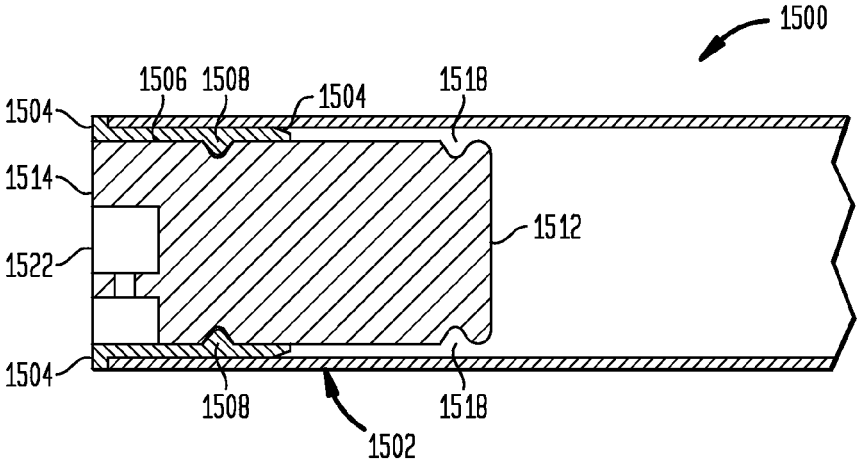
FIG. 15 shows a cross-sectional view of a portion of an OPC drum assembly prior to installation in accordance with the present invention.
Figure 16:
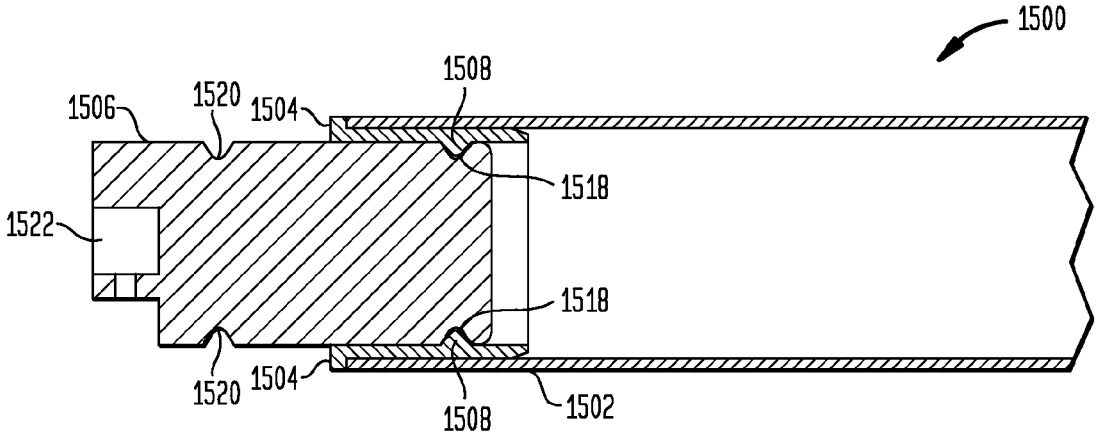
FIG. 16 shows a cross-sectional view of a portion of the OPC drum assembly of FIG. 15 after installation in accordance with the present invention.
Figure 17:
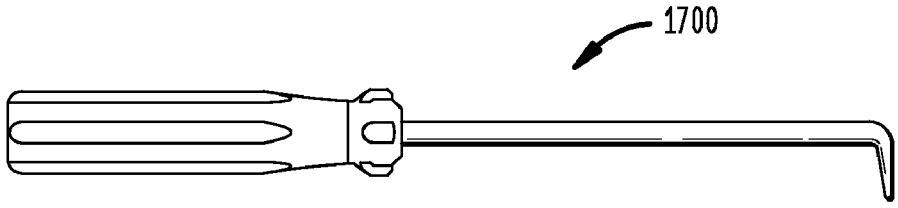
FIG. 17 shows a tool for use with the OPC drum assembly of FIG. 15 in accordance with the present invention.

FIG. 15 shows a cross-sectional view of a portion of an OPC drum assembly 1500 prior to installation in accordance with the present invention. FIG. 16 shows a cross-sectional view of the OPC drum assembly 1500 after installation in accordance with the present invention. The OPC drum assembly 1500 comprises an OPC drum 1502, an internal retaining member 1504 and a retractable hub 1506. The internal retaining member 1504 is shaped to be placed into the interior of the OPC drum 1502 and may be held in place by glue or some other suitable technique. The internal retaining member 1504 is preferably cylindrical and includes a rib 1508 which extends into the interior of the internal retaining member 1504. A portion of the internal retaining member 1504 may extend outward from the interior of the OPC drum 1502. The internal retaining member 1504 may be formed from plastic resin and by injection molding. The retractable hub 1506 comprises a generally cylindrical portion 1514 sized to fit within the cylindrical openings 19 or 121 and a portion 1512 sized to engage the internal retaining member 1504. The retractable hub 1506 also includes two slots 1518 and 1520 sized to engage the rib 1508 of the internal retaining member 1504. A notch 1522 can be engaged by a tool 1700, shown in FIG. 17, to control the position of the retractable hub 1506. The retractable hub 1506 may be formed from plastic resin and by injection molding. For installation into a toner cartridge, the internal retaining member 1504 is inserted into an end the OPC drum 1502 and secured in place, preferably with an adhesive. The retractable hub 1506 is then inserted into the internal retaining member 1504 to the position where the slot 1520 engages the rib 1508, as seen in FIG. 15. The OPC drum assembly 1500 is placed into position between the OPC retaining members 118 and 120. The tool 1700 is inserted through the adjacent cylindrical opening 119 or 121 and interlocks with the notch 1522. The tool 1700 is then used to pull the retractable hub into the cylindrical opening 119 or 121 and into the position where the rib 1508 engages the slot 1518. Adhesives or locking features may be used to ensure that the retractable hub 1506 stays in position during operation of the toner cartridge. The same technique or an alternate technique may be utilized for the installation of the other end of the OPC drum 1502. Quality bearing surfaces and concentricity between the bearing surfaces and the center of rotation of the OPC drum 1502 should be maintained for proper operation of the toner cartridge and to prevent print defects due to out of round rotation of the OPC drum 1502.

Figure 18:
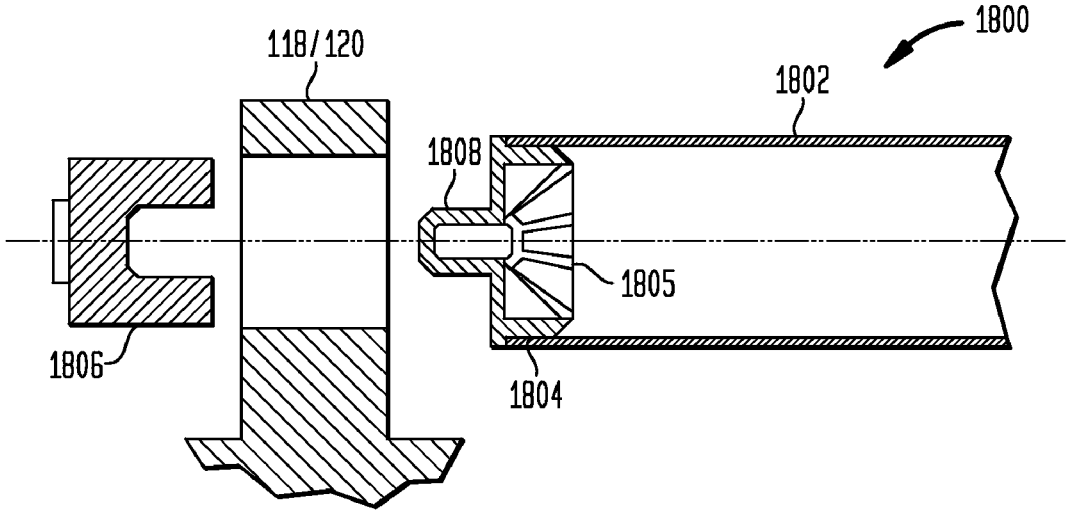
FIG. 18 shows a cross-sectional view of a portion of an OPC drum assembly in accordance with one aspect of the present invention.

FIG. 18 shows a cross-sectional view of a portion of an OPC drum assembly 1800 in accordance with another aspect of the present invention. The OPC drum assembly 1800 comprises an OPC drum 1802, an internal retaining member 1804 and an external hub portion 1806. The internal retaining member 1804 is shaped to be placed into the interior of the OPC drum 1802 and may be held in place by glue or some other suitable technique. The internal retaining member 1804 includes an extension member 1808 which functions as a portion of a hub. The internal retaining member 1804 may also include structural members 1805 which provide additional support and rigidity to the internal retaining member 1804. The internal retaining member 1804 may be formed from plastic resin and by injection molding. The external hub portion 1806 comprises a body, which when mated with the extension member 1808 forms a complete hub. In one aspect of the present invention, the external hub portion 1806 may comprise a trilobe gear. The external hub 1806 is generally cylindrical in shape and may be formed from plastic resin and by injection molding. For installation into a toner cartridge, the OPC drum 1802 (with the internal retaining member 1804 inserted into an end) is placed into position between the OPC retaining members 118 and 120, with the extension member 1808 extending towards the adjacent cylindrical opening 119 or 121. The external hub portion 1806 is then attached, by adhesives or a locking feature for example, onto the extension member 1808 to form a complete hub. To facilitate ease of installation on the non-drive side end cap 116, flange 122 of the OPC retaining member 120 may be removed by machining if needed. The same technique or an alternate technique may be utilized for the installation of the other end of the OPC drum 1802. Quality bearing surfaces and concentricity between the bearing surfaces and the center of rotation of the OPC drum 1802 should be maintained for proper operation of the toner cartridge and to prevent print defects due to out of round rotation of the OPC drum 1802.

For some imaging systems, such as the HP 2600 printer, it may be possible to utilize a replacement OPC drum which is shorter than the OPC drum initially provided by the manufacturer. Such a shorter OPC drum would allow for greater ease of installation between the fixed end caps. However, a shorter OPC drum must be held in the proper position with respect to the paper path of the printer. For example, the shorter OPC drum should not abut one of the end caps and thus leave a large gap between the other end of the OPC drum and the opposing end cap. Specifically, for the HP 2600, the manufacturer provides an OPC drum with a writeable area of approximately 10.1 inches in length. It may be possible to utilize a shortened OPC drum replacement which is as much as 4.1 inches shorter in length, and thus facilitate installation of the OPC drum without compromising the effectiveness of the toner cartridge.

Figure 19:
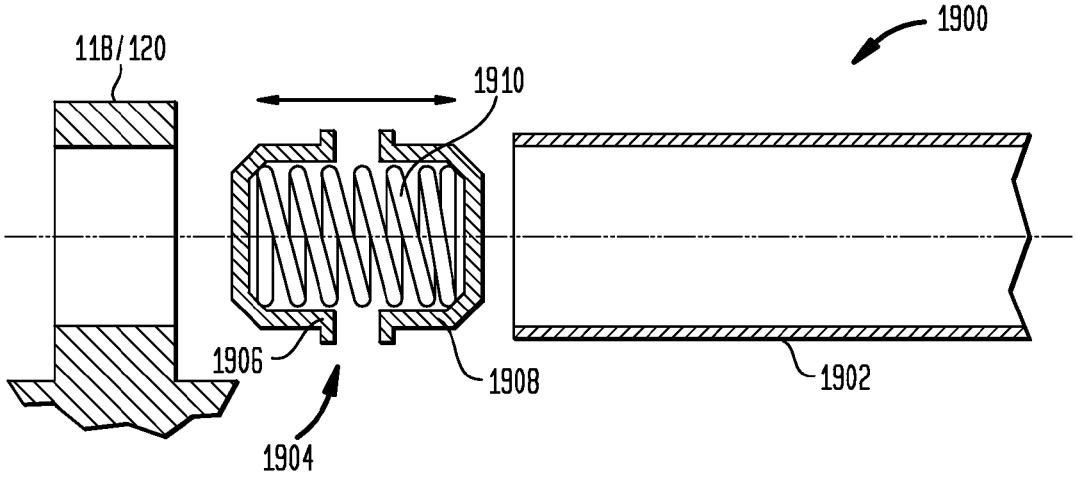
FIG. 19 shows a cross-sectional view of a shortened OPC drum assembly in accordance with the present invention.

FIG. 19 shows a cross-sectional view of a portion of an OPC drum assembly 1900 in accordance with the present invention. The OPC drum assembly 1900 comprises an OPC drum 1902 and a collapsible hub 1904. In a preferred embodiment, the OPC drum 1902 comprises an OPC drum which is shorter than the OPC drum provided by the manufacturer of the original OPC drum. As seen in FIG. 19, the collapsible hub 1904 comprises a first hub portion 1906, a second hub portion 1908 and a spring 1910 positioned between the two hub portions 1906 and 1908. The first hub portion 1906 is generally cylindrical in shape and is sized to fit within the cylindrical openings 119 or 121. The second hub portion 1908 is generally cylindrical in shape and is sized to fit within the interior of the OPC drum 1902. The hub portions 1906 and 1908 may be formed from plastic resin and by injection molding. For installation into a toner cartridge, the OPC drum 1902 is placed into position between the OPC retaining members 118 and 120. The collapsible hub 1906 is then compressed and placed between the adjacent cylindrical opening 119 or 121 and an end of the OPC drum 1902. (Alternatively, the OPC drum 1902, with the collapsible hub 1906 previously installed and compressed, may be placed between the OPC retaining members 118 and 120.) Next, the compression on the collapsible hub 1906 is released and the pressure from the spring 1910 forces the first hub portion 1904 into the cylindrical opening 119 or 121 and the second hub portion into the interior of the OPC drum 1902. The same technique or an alternate technique may be utilized for the installation of the other end of the OPC drum 1902. Quality bearing surfaces and concentricity between the bearing surfaces and the center of rotation of the OPC drum 1902 should be maintained for proper operation of the toner cartridge and to prevent print defects due to out of round rotation of the OPC drum 1902.

Figure 20:
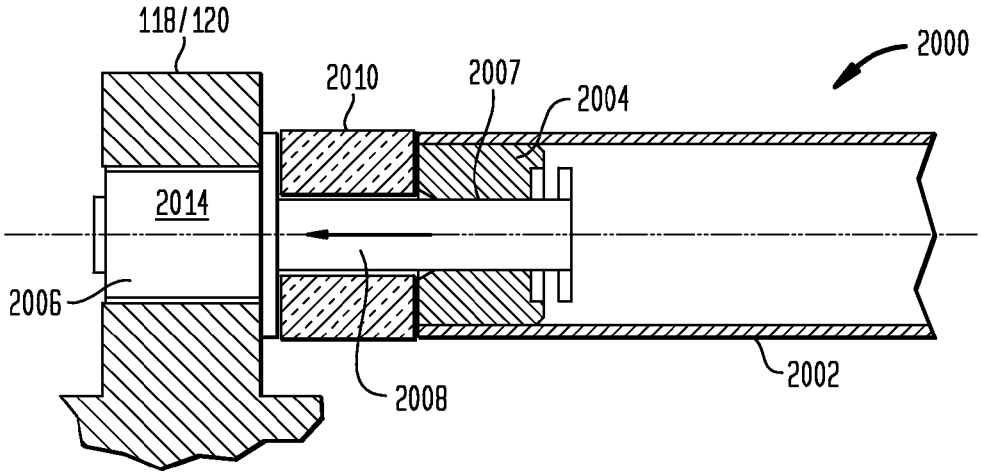
FIG. 20 shows a cross-sectional view of a shortened OPC drum assembly in accordance with another aspect of the present invention.

FIG. 20 shows a cross-sectional view of a portion of an OPC drum assembly 2000 after installation in accordance with the present invention. The OPC drum assembly 2000 comprises an OPC drum 2002, an internal retaining member 2004, a retractable hub 2006 and an insertable rigid spacer 2010. In a preferred embodiment, the OPC drum 2002 comprises an OPC drum which is shorter than the OPC drum provided by the manufacturer of the original OPC drum. The insertable rigid spacer 2010 is preferably round and taut and is adapted to be attached to the shaft 2008 in a manner like a snap ring. The internal retaining member 2004 is shaped to be placed into the interior of the OPC drum 2002 and may be held in place by glue or some other suitable technique. The internal retaining member 2004 is preferably cylindrical and includes an opening 2007 which holds a shaft 2008 of the retractable hub 2006. A portion of the internal retaining member 2004 may extend outward from the interior of the OPC drum 2002. The internal retaining member 2004 may be formed from plastic resin and by injection molding. The retractable hub 2006 comprises a generally cylindrical portion 2014 sized to fit within the cylindrical openings 119 or 121 and the shaft portion 2008 sized to slide through the opening 2007. The retractable hub 2006 may be formed from plastic resin and by injection molding. For installation into a toner cartridge, the internal retaining member 2004 (with the shaft 2008 of the retractable hub 2006 is inserted into the opening 2007) is placed into an end the OPC drum 2002 and secured in place, preferably with an adhesive. The retractable hub 2006 is thus capable of being moved freely into and out of the OPC drum 2002. The OPC drum assembly 2000 is placed into position between the OPC retaining members 118 and 120. The retractable hub 2006 is then pulled into the cylindrical opening 119 or 121 and the insertable rigid spacer 2010 is then attached to the shaft 2008, as shown in FIG. 20, to hold the OPC drum 2002 in the appropriate location for the operation of the toner cartridge. The same technique or an alternate technique may be utilized for the installation of the other end of the OPC drum 2002. Quality bearing surfaces and concentricity between the bearing surfaces and the center of rotation of the OPC drum 2002 should be maintained for proper operation of the toner cartridge and to prevent print defects due to out of round rotation of the OPC drum 2002. The use of a spacer, such as the insertable rigid spacer 2010, may be utilized with OPC drum assembly having a shortened OPC drum, and thus in need of a mechanism to keep the shortened OPC drum centered in the appropriate location for operation of the toner cartridge. For example, the insertable rigid spacer 2010 may be utilized with the OPC drum assembly 2100 described below.

Figure 21:
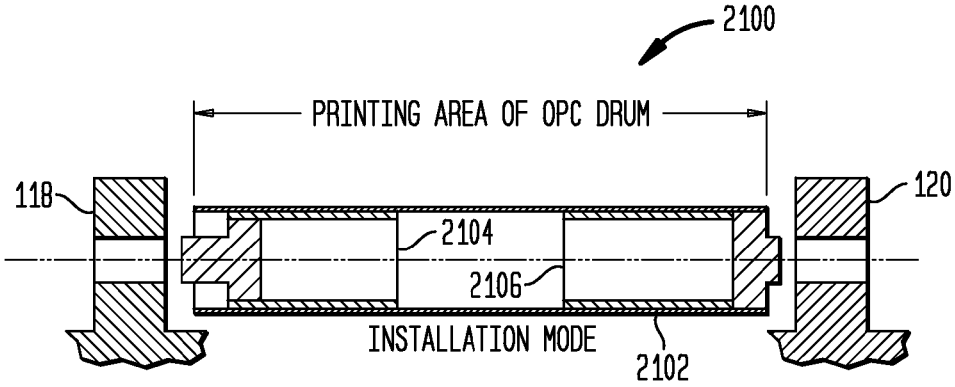
FIG. 21 shows a cross-sectional view of an OPC drum assembly prior to installation in accordance with the present invention.
Figure 22:
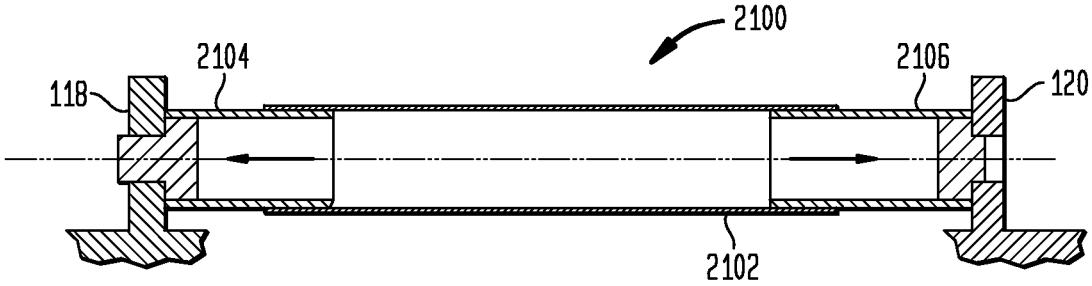
FIG. 22 shows a cross-sectional view of the OPC drum assembly of FIG. 21 after installation in accordance with the present invention.

FIG. 21 shows a cross-sectional view of an OPC drum assembly 2100 prior to installation in accordance with the present invention. FIG. 22 shows a cross-sectional view of the OPC drum assembly 2100 after installation in accordance with the present invention. The OPC drum assembly 2100 comprises an OPC drum 2102 and retractable hubs 2104 and 2106. In a preferred embodiment, the OPC drum 2102 comprises an OPC drum which is shorter than the OPC drum provided by the manufacturer of the original OPC drum. The retractable hubs 2104 and 2106 each include a hub portion and a body portion sized to slidably fit within the OPC drum 2102. For installation into a toner cartridge, the OPC drum assembly 2100 with the retractable hubs 2104 and 2106 pushed in is placed into position between the OPC retaining members 118 and 120, as seen in FIG. 21. The retractable hubs 2104 and 2106 are then withdrawn into the OPC retaining members 118 and 120, respectively. A spacer, such as the insertable rigid spacer 2010, may optionally be used to secure the OPC drum 2102 in place.

Figure 23:
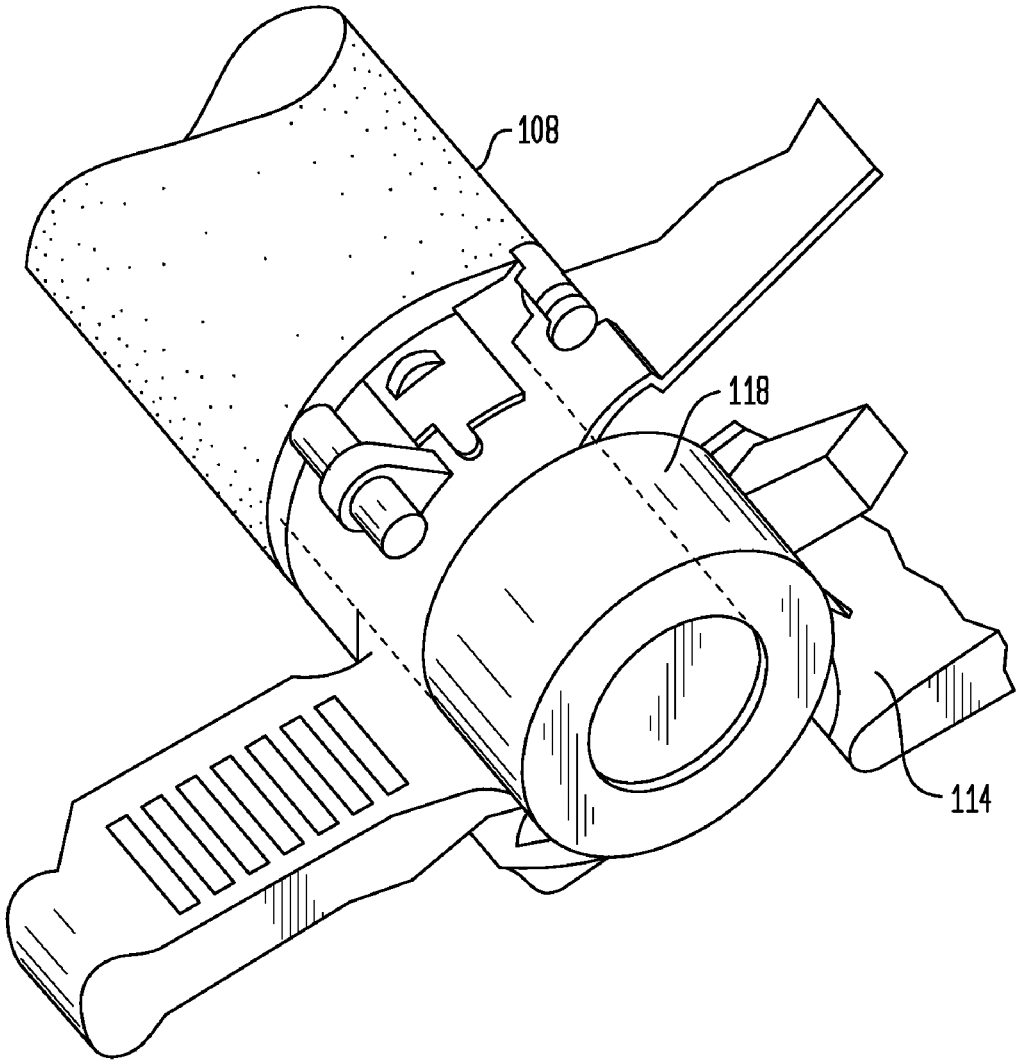
FIG. 23 shows a perspective view of a non-drive side end of a waste bin assembly.
Figure 24:
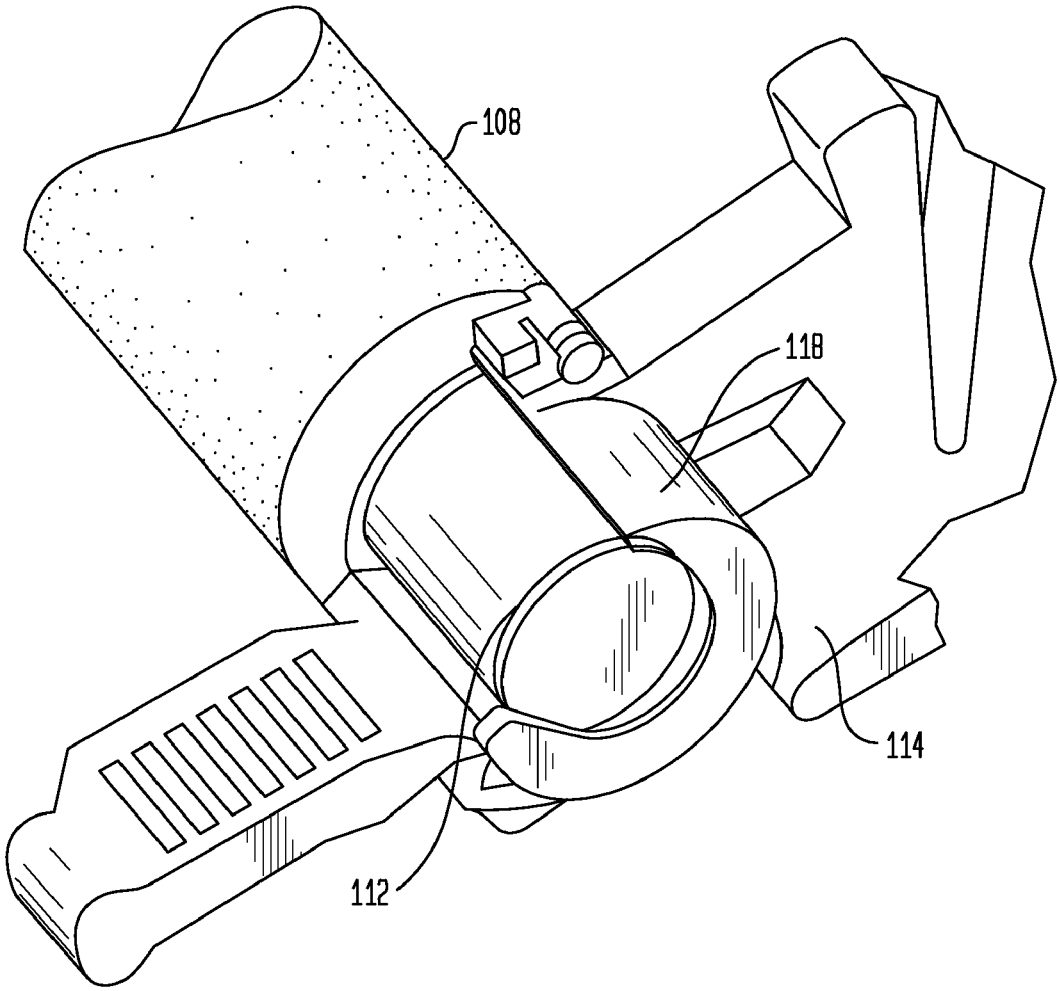
FIG. 24 shows a perspective view of a non-drive side end of a waste bin with a section removed in accordance with the present invention.
Figure 25:
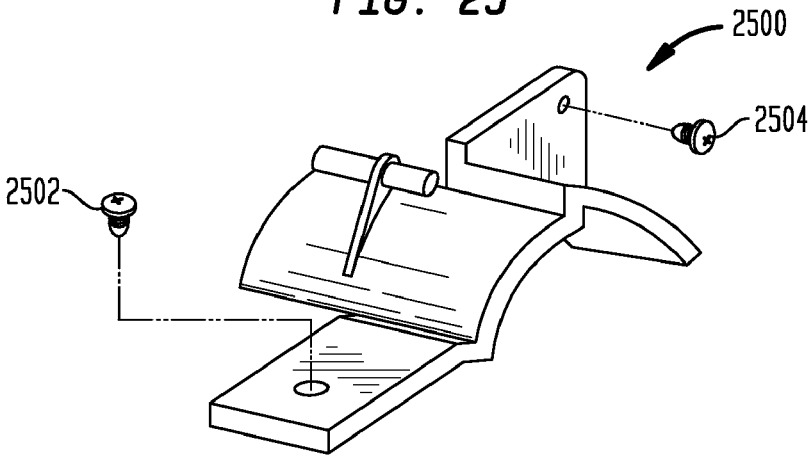
FIG. 25 shows a perspective view of an end cap patch in accordance with the present invention.

In another aspect of the present invention, either a portion of the drive side end cap 114, a portion of the non-drive side end cap 116, or a portion of both end caps 114 and 116 may be removed to facilitate the removal of an existing OPC drum and the installation of a replacement OPC drum. FIG. 23 shows a perspective view of a portion of the non-drive side end cap 114 of the waste bin assembly 104. To remove the OPC drum 108, a portion of the end cap 114 may be removed. FIG. 24 shows a perspective view of the non-drive side end cap 114 of the waste bin assembly 104 with a portion of the end cap 114 removed. The portion of the non-drive side end cap 114 may be removed by cutting or machining, for example. After this portion has been removed, the existing OPC drum 108 may be removed and the area cleared of debris. A replacement OPC drum is then installed in its place. Next, the end cap 114 should be repaired to allow for the proper operation and rotation of the replacement OPC. In one aspect of the present invention as shown in FIG. 25, an appropriately shaped patch 2500 may be attached to the end cap 114 to fill the portion removed. The patch 2500 may be formed by injection molding or other suitable techniques. The patch 2500 may be secured to the end cap 114 by screws 2502 and 2504, adhesive, or some other suitable technique. The use of screws 2502 and 2504 would allow for future ease of remanufacture by providing for the ready removal of the OPC drum during the next replacement cycle. Pilot holes may be drilled in the end cap 114 to allow insertion of the screws 2502 and 2504. Alternately, the removed portion may be reattached by an adhesive, ultrasonic welding or some other suitable technique.

Figure 26:
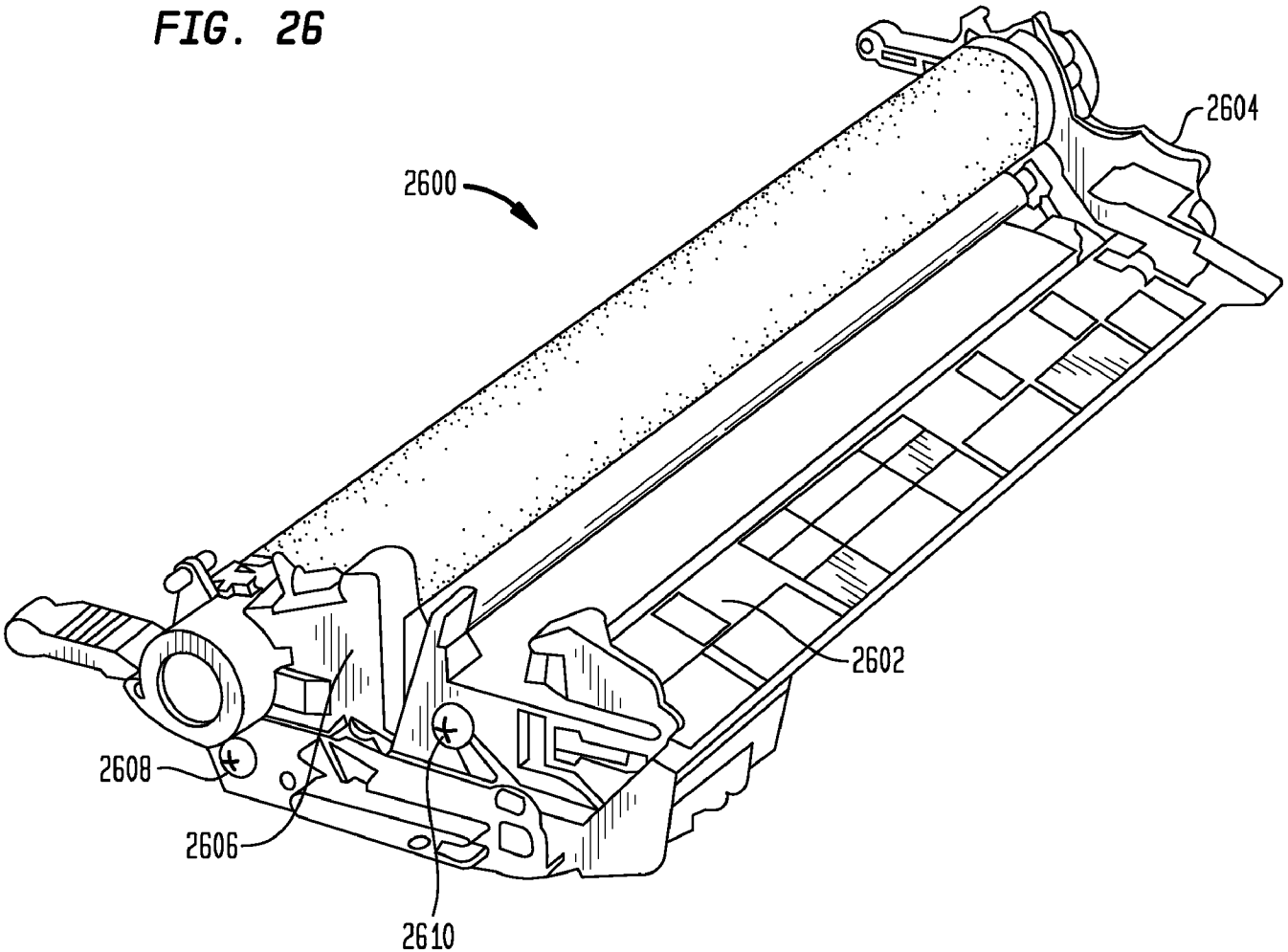
FIG. 26 shows a perspective view of a replacement waste bin assembly in accordance with the present invention.

In another aspect of the present invention, a new waste bin assembly may be formed which would replace the existing waste bin assembly 104 after the waste bin assembly 104 has been removed. The waste bin assembly 104 may be removed from the toner cartridge 100 without causing undesirable damage to the toner cartridge 100. FIG. 26 shows a perspective view a replacement waste bin assembly 2600 in accordance with the present invention. The replacement waste bin assembly 2600 comprises a waste bin 2602, a drive side end cap 2604 and a non-drive side end cap 2606. The replacement waste bin assembly 2600 may substantially conform to the structure of the waste bin assembly 104 provided by the original equipment manufacturer, or the replacement waste bin assembly 2600 may differ from the waste bin assembly 104 in various structural or function ways. For example, the end caps 2604 and 2606 may be attached to the waste bin using screws 2608 and 2610, snap fit members, or other suitable techniques which allow the end caps 2604 and 2606 to be removed from the waste bin 2600 without causing damage to any components of the toner cartridge 100. Such removable end caps 2604 and 2606 would allow for future replacement of the OPC drum without the requirement to use techniques, such as the techniques described above, for replacement of the OPC drum between end caps which are fixed in place and not readily removable without causing damage to the waste bin assembly. Alternatively, one end cap, such as the non-drive side end cap 2606, may be permanently affixed to the waste bin 2602 and the other end cap, such as drive side end cap 2606, may be attached to the waste bin in a fashion, by screws for example, which allows for the easy removal of the end cap. In another aspect of the present invention, the waste bin 2602 may include a capacity greater than the capacity of the waste bin 106 supplied by the original equipment manufacturer, thus allowing for the use of a greater quantity of toner by the toner cartridge 100.

Figure 27:
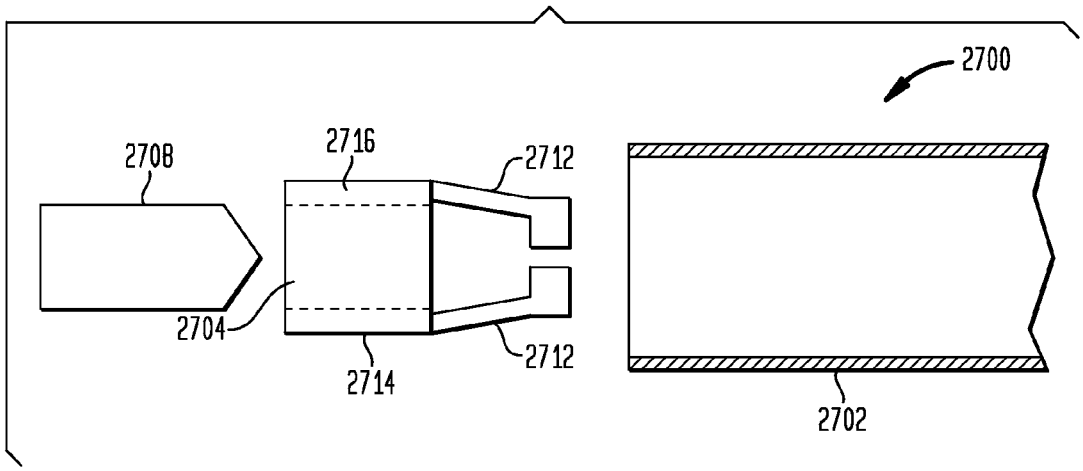
FIG. 27 shows a cross-sectional view of a portion of an OPC drum assembly prior to installation in accordance with the present invention.
Figure 28:
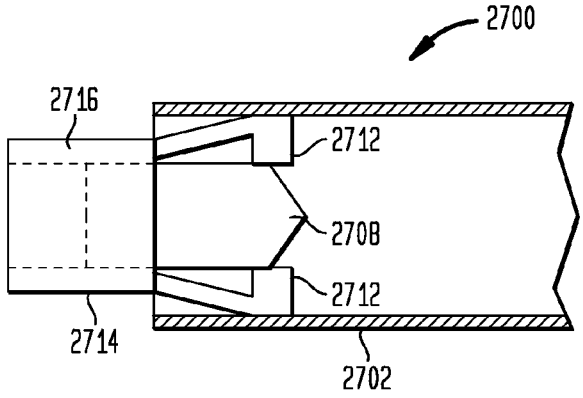
FIG. 28 shows a cross-sectional view of a portion of the OPC drum assembly of FIG. 27 after installation in accordance with the present invention.

FIG. 27 shows a cross-sectional view of a portion of an OPC drum assembly 2700 prior to installation in accordance with the present invention. FIG. 28 shows a cross-sectional view of the OPC drum assembly 2700 after installation in accordance with the present invention. The OPC drum assembly 2700 comprises an OPC drum 2702, a hub 2706 and an expansion member 2708. The external hub 2706 comprises a cylindrical body 2714 sized to fit within the cylindrical openings 119 or 121 and a plurality of expansion extensions 2712. The external hub also includes a center bore 2704. The external hub 2706 is generally cylindrical in shape and may be formed from plastic resin and by injection molding. The expansion member 2708 is sized to fit within the center bore 2704. For installation into a toner cartridge, the OPC drum 2702 is placed into position between the OPC retaining members 118 and 120. The external hub 2706 is inserted through the adjacent cylindrical opening 119 or 121 until the expansion extensions 2712 are disposed within the OPC drum 2702. The expansion member 2708 is then inserted into the center bore 2704, engages the expansion extensions 2712 and forces the expansion extensions 2712 into contact with the interior of the OPC drum 2702, thus holding the OPC drum 2702 in place. Adhesives or locking features may be used to ensure that the external hub 2706 does not move during operation of the toner cartridge. To facilitate ease of installation on the non-drive side end cap 116, flange 122 of the OPC retaining member 120 may be removed by machining if needed. In another aspect of the present invention, the installation may be performed by first placing external hub 2706 into the cylindrical opening 119 or 121, placing OPC drum 2702 into position between the OPC retaining members 118 and 120, and then installing the expansion member 2708. The same technique or an alternate technique may be utilized for the installation of the other end of the OPC drum 2702. Quality bearing surfaces and concentricity between the bearing surfaces and the center of rotation of the OPC drum 2702 should be maintained for proper operation of the toner cartridge and to prevent print defects due to out of round rotation of the OPC drum 2702.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of remanufacturing an imaging cartridge comprising:

providing the imaging cartridge comprising an organic photo conductor (OPC) retaining member including an opening;

providing a replacement OPC drum including an internal hub;

placing the OPC drum proximate the OPC retaining member; and withdrawing at least a portion of the internal hub into said opening of the OPC retaining member.

2. The method of claim 1 wherein a tool is utilized to withdraw at least the portion of the internal hub into said opening of the OPC retaining member.

3. A method of remanufacturing an imaging cartridge comprising:

providing the imaging cartridge comprising an organic photo conductor (OPC) retaining member including an opening;

providing a replacement OPC drum including an axially extendable hub;

placing the OPC drum proximate the OPC retaining member; and extending the axially extendable hub into the opening of the OPC retaining member.

4. The method of claim 3 wherein a tool is utilized to extend the axially extendable hub into the opening of the OPC retaining member.

* * * * *